US009851099B2

(12) United States Patent
Taylor et al.

(10) Patent No.: US 9,851,099 B2
(45) Date of Patent: Dec. 26, 2017

(54) FLAT-FLAME NOZZLE FOR BURNER

(71) Applicant: HONEYWELL INTERNATIONAL INC., Morristown, NJ (US)

(72) Inventors: Curtis L. Taylor, Gaston, IN (US); Brad Patterson, Dunkirk, IN (US); Tracy Fine, Farmland, IN (US); Jayson Perdue, New Castle, IN (US)

(73) Assignee: Honeywell International Inc., Morris Plains, NJ (US)

( * ) Notice: Subject to any disclaimer, the term of this patent is extended or adjusted under 35 U.S.C. 154(b) by 174 days.

(21) Appl. No.: 14/771,245

(22) PCT Filed: Mar. 5, 2013

(86) PCT No.: PCT/US2013/029117
§ 371 (c)(1),
(2) Date: Aug. 28, 2015

(87) PCT Pub. No.: WO2014/137323
PCT Pub. Date: Sep. 12, 2014

(65) Prior Publication Data
US 2016/0003472 A1 Jan. 7, 2016

(51) Int. Cl.
*F23D 14/32* (2006.01)
*F23D 14/48* (2006.01)
(Continued)

(52) U.S. Cl.
CPC ..... *F23D 14/48* (2013.01); *F23D 14/32* (2013.01); *F23D 14/586* (2013.01);
(Continued)

(58) Field of Classification Search
CPC ..... F23D 14/48
(Continued)

(56) References Cited

U.S. PATENT DOCUMENTS 2,735,482 A 2/1956 Tuttle
3,361,183 A * 1/1968 Reichhelm ..... F23C 99/00 431/116
(Continued)

FOREIGN PATENT DOCUMENTS

CN 2648291 Y 10/2004
CN 202501472 U 10/2012
GB 229242 A 3/1925

OTHER PUBLICATIONS

International Search Report and Written Opinion from related PCT Application PCT/US2013/029117 dated May 20, 2013, 8 pp.
(Continued)

*Primary Examiner* — Avinash Savani
(74) *Attorney, Agent, or Firm* — Brooks, Cameron & Huebsch, PLLC

(57) ABSTRACT

According to the present disclosure, a flat-flame nozzle is provided for producing a flat flame in a flame chamber included in a burner assembly. The flat-flame nozzle is configured to conduct fuel from a fuel supply to an ignition zone in the flame chamber. In some illustrative embodiments, the flat-flame nozzle is also configured to conduct oxygen from an oxygen supply to the ignition zone to produce a combustible oxygen-fuel mixture in the flame chamber. In illustrative embodiments, a removable first plate-separation border frame is positioned to lie between a first lower plate and a companion first upper plate. This border frame is configured to cooperate with those plates to form in the flat-flame nozzle a fuel-discharge outlet and a fuel-transport passageway communicating with the fuel-discharge outlet.

22 Claims, 14 Drawing Sheets

(51) Int. Cl.
*F23M 5/02* (2006.01)
*F23D 14/58* (2006.01)

(52) U.S. Cl.
CPC ..... *F23M 5/025* (2013.01); *F23D 2203/007* (2013.01); *F23D 2203/106* (2013.01); *F23D 2900/00013* (2013.01)

(58) Field of Classification Search
USPC ..... 431/116, 354, 351
See application file for complete search history.

(56) References Cited

U.S. PATENT DOCUMENTS 4,611,219 A * 9/1986 Sugitani ..... B05B 1/14 347/40
5,215,259 A 6/1993 Wark
5,224,855 A 7/1993 Toyonaga et al.
5,285,967 A * 2/1994 Weidman ..... B05B 7/205 239/132.1
5,611,682 A 3/1997 Slavejkov et al.
5,725,367 A 3/1998 Joshi et al.
7,390,189 B2 6/2008 D'Agostini
8,956,155 B2 * 2/2015 Benedetti ..... F24C 3/006 126/500
2005/0123874 A1 * 6/2005 Abbasi ..... F23C 6/042 431/351
2009/0280444 A1 11/2009 Watson et al.
2011/0146545 A1 6/2011 Morse et al.
2011/0244411 A1 * 10/2011 Rochat ..... F23D 14/10 431/354

OTHER PUBLICATIONS

Eclipse PrimeFire 400 Burners, http://docuthek.kromschroeder.com/documents/download.php?lang=en&doc=46777, Mar. 2010, 1 pp.
Search Report from related European Application 13876928.6 dated Sep. 26, 2016 (6 pages).
Office Action from related China Patent Application No. 201380076329, dated Nov. 2, 2016, 20 pp.

* cited by examiner

FLAT-FLAME NOZZLE FOR BURNER

BACKGROUND

The present disclosure relates to burners, and particularly to oxygen-fuel burner assemblies. More particularly, the present disclosure relates to nozzles for producing flat flames in oxygen-fuel burner assemblies.

SUMMARY

According to the present disclosure, a flat-flame nozzle is provided for producing a flat flame in a flame chamber included in a burner assembly. The flat-flame nozzle is configured to conduct fuel from a fuel supply to an ignition zone in the flame chamber. In some illustrative embodiments, the flat-flame nozzle is also configured to conduct oxygen from an oxygen supply to the ignition zone to produce a combustible oxygen-fuel mixture in the flame chamber.

In illustrative embodiments, a removable first plate-separation border frame is positioned to lie between a first lower plate and a companion first upper plate. This border frame is configured to cooperate with those plates to form in the flat-flame nozzle a fuel-discharge outlet and a fuel-transport passageway communicating with the fuel-discharge outlet. Fasteners are provided to releasably retain the removable first plate-separation border frame in a stationary position between the first lower plate and the first upper plate to establish a first flow velocity of fuel flowing through the fuel-transport passageway toward the fuel-discharge outlet. The fasteners can be removed by a technician at an industrial plant to allow for replacement of the removable first plate-separation border frame with a relatively thicker or thinner removable alternate first plate-separation border frame. This modification causes a change in the volume of the fuel-transport passageway and the size of the fuel-discharge outlet formed in the flat-flame nozzle. Using the removable alternate first plate-separation border frame of a different thickness establishes a different second flow velocity of fuel flowing through the fuel-transport passageway to and through the fuel-discharge outlet.

In illustrative embodiments, each plate-separation border frame includes a separator strip trapped between top and bottom gaskets. The separator strip is made of stainless steel and each gasket is made of a relatively softer material such as copper. The thickness of the plate-separation border frame can be changed by varying the thickness of the separator strip.

A collection of plate-separation border frames of varying thicknesses can be stored at an industrial plant so as to be available to technicians. Then the fired capacity of a burner at the plant can be changed in the field by a technician simply by replacing a first plate-separation border frame with an alternate first separation border frame having a different thickness.

In other illustrative embodiments, the flat-flame nozzle is configured to conduct streams of oxygen in addition to streams of fuel. Such an oxygen-fuel flat-flame nozzle is formed to include a lower oxygen-transport passageway terminating at a lower oxygen-discharge outlet located below the fuel-discharge outlet and an upper oxygen-transport passageway terminating at an upper oxygen-discharge outlet located above the fuel-discharge outlet. The oxygen-fuel flat-flame nozzle is formed to locate the fuel-transport passageway between the lower and upper oxygen-transport passageways.

In illustrative embodiments, the oxygen-fuel flat-flame nozzle includes a second lower plate arranged to lie below and in spaced-apart relation to the first lower plate to locate the lower oxygen-transport passageway and the lower oxygen-discharge outlet therebetween. A removable second plate-separation border frame is arranged to lie between the first and second lower plates. The oxygen-fuel flat-flame nozzle also includes a second upper plate arranged to lie above and in spaced-apart relation to the first upper plate to locate the upper oxygen-transport passageway and the upper oxygen-discharge outlet therebetween. A removable third plate-separation border frame is arranged to lie between the first and second upper plates.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIG. 12 is a sectional view taken along line 12-12 of FIG. 13 of an oxygen-fuel burner unit showing a second embodiment of a flat-flame nozzle configured to conduct fuel and oxygen along separate flow paths to provide means for generating a flat flame and showing (in an illustrative embodiment) that the oxygen-fuel flat-flame nozzle is arranged to extend through an oxygen-supply housing so that fuel and oxygen discharged from the flat-flame nozzle mixes in a flame chamber formed in a burner block cooperate to provide a combustible mixture in the flame chamber and showing that a rotatable oxygen-flow control valve is coupled to the underside of the oxygen-supply housing and configured to vary the supply of oxygen provided to the flame chamber via a primary oxygen chamber formed in the oxygen-supply housing;

FIG. 13 is a perspective view of the oxygen-fuel burner unit of FIG. 12 with portions broken away to show the horizontally extending oxygen-fuel flat-flame nozzle mounted in the oxygen-supply housing and arranged to terminate in the flame chamber formed in the burner block and showing a valve rotator configured to provide means for rotating the oxygen-flow control valve of FIG. 12 about a horizontal axis of rotation to vary the flow of oxygen discharged from an oxygen-distribution system into the oxygen-supply housing;

FIG. 14 is an enlarged perspective view of the oxygen-fuel flat-flame nozzle of FIGS. 12 and 13;

FIG. 15 is an exploded perspective assembly view of components that cooperate to form the oxygen-fuel flat-flame nozzle of FIG. 14 showing a bottom cover including a second lower plate and an oxygen-inlet pipe coupled to an upstream end of the second lower plate, a top cover including a second upper plate and a fuel-inlet pipe coupled to an upstream end of the second upper plate, a series of plates (two) and U-shaped plate-separation border frames (three) arranged to lie between the second lower plate and the second upper plate, and fasteners for retaining the plates and border frames in stationary positions relative to one another to form the flat-flame nozzle and suggesting that each of the thin U-shaped plate-separation border frames could be replaced by an alternate U-shaped plate-separation border frame to change the velocity of fuel or oxygen flowing through a passageway defined by such plate-separation border frames;

FIG. 16 is a side elevation view of the oxygen-fuel flat-flame nozzle of FIG. 12;

FIG. 17 is a sectional view taken along line 17-17 of FIG. 18 of an oxygen-fuel burner unit showing a third embodiment of a flat-flame nozzle configured to conduct fuel and oxygen along separate flow paths to provide means for generating a flat flame and showing that the oxygen-fuel flat-flame nozzle is arranged to extend through an oxygen-supply housing so that fuel and oxygen discharged from the flat-flame nozzle mixes in a flame chamber formed in a burner block to provide a combustible mixture in the flame chamber;

FIG. 18 is a perspective view of the oxygen-fuel burner unit of FIG. 17 with portions broken away to show the horizontally extending oxygen-fuel flat-flame nozzle mounted in the oxygen-supply housing and arranged to terminate in the flame chamber formed in the burner block;

FIG. 19 is an enlarged perspective view of the oxygen-fuel flat-flame nozzle of FIGS. 17 and 18;

FIG. 20 is an exploded perspective assembly view of components that cooperate to form the oxygen-fuel flat-flame nozzle of FIG. 19 showing a bottom cover including a second lower plate and an oxygen-inlet pipe coupled to an upstream end of the second lower plate, a top cover including a second upper plate and a fuel-inlet pipe coupled to an upstream end of the second upper plate, and a series of plates (two) and unassembled U-shaped plate-separation border frames (three) arranged to lie between the second lower plate and the second upper plate and each border frame is defined by a thin U-shaped top gasket, a relatively thicker U-shaped separator strip, and a thin U-shaped bottom gasket, and fasteners for retaining the plates and border frames in stationary positions relative to one another to form the flat-flame nozzle;

FIG. 21 is a side elevation view of the oxygen-fuel flat-flame nozzle of FIG. 17.

DETAILED DESCRIPTION

Figure 1:
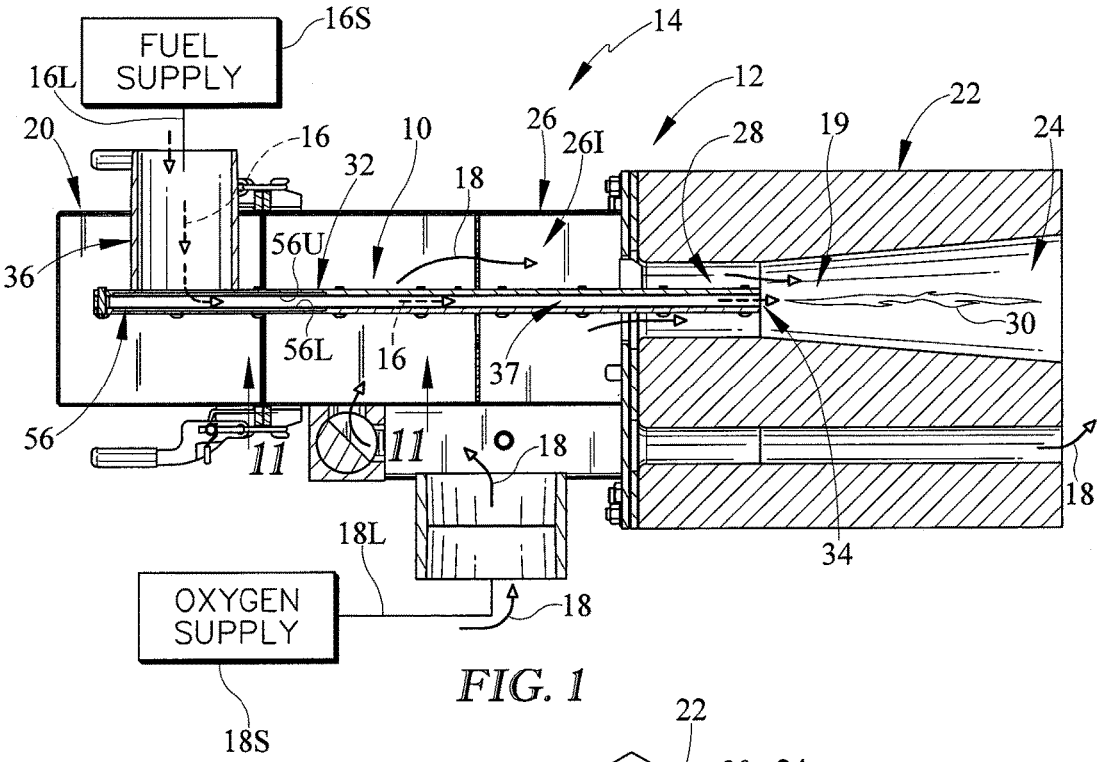
FIG. 1 is a sectional view taken along line 1-1 of FIG. 2 of an oxygen-fuel burner unit showing a first embodiment of a flat-flame nozzle configured to conduct fuel and to provide means for generating a flat flame when fuel conducted by the flat-flame nozzle is exposed to oxygen to produce a combustible oxygen-fuel mixture that is ignited and showing that the flat-flame nozzle is arranged to extend through an oxygen-supply housing so that fuel discharged from the flat-flame nozzle mixes in a flame chamber formed in a burner block with oxygen flowing from the oxygen-supply housing into the flame chamber through an oxygen-flow passageway containing portions of the flat-flame nozzle and showing that a rotatable oxygen-flow control valve is coupled to the underside of the oxygen-supply housing and configured to vary the supply of oxygen provided to mix with fuel discharged from the flat-flame nozzle into the flame chamber.
Figure 2:
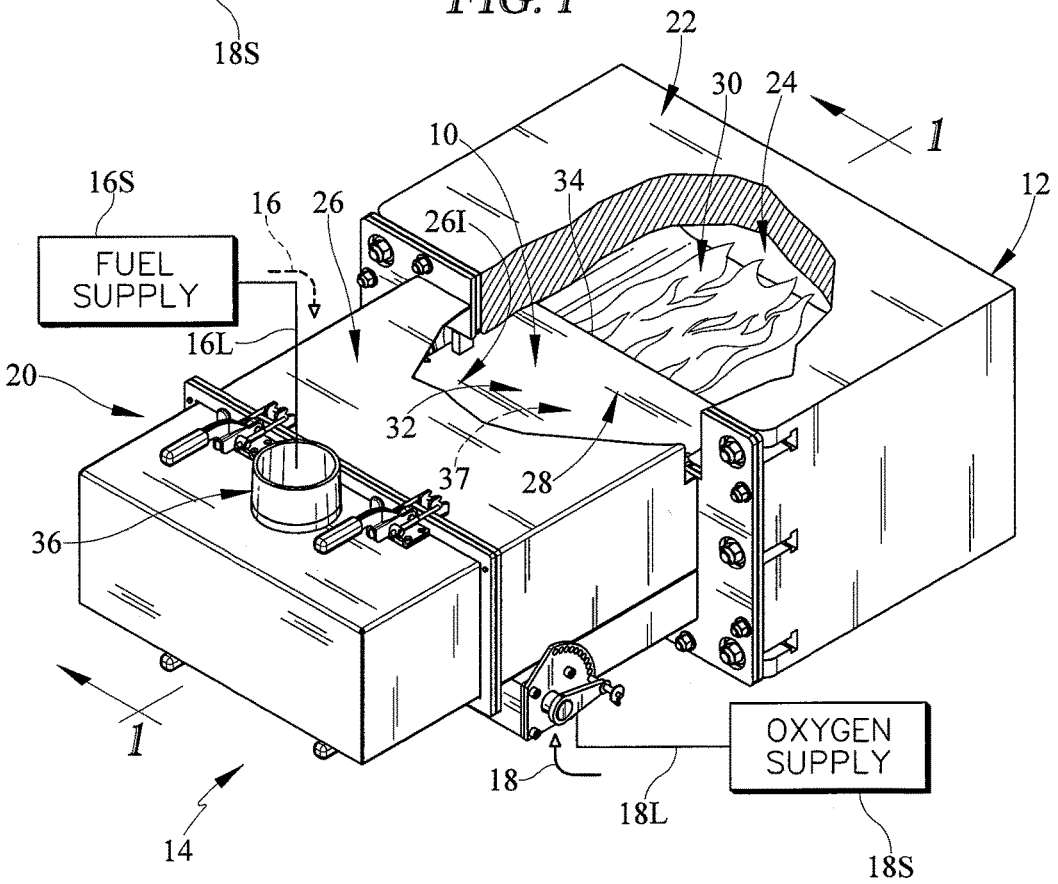
FIG. 2 is a perspective view of the oxygen-fuel burner unit of FIG. 1 with portions broken away to show the horizontally extending flat-flame nozzle mounted in the oxygen-supply housing and arranged to terminate in the flame chamber formed in the burner block and showing a valve rotator configured to provide means for rotating the oxygen-flow control valve of FIG. 1 about a horizontal axis of rotation to vary the flow of oxygen discharged from an oxygen-distribution system into the oxygen-supply housing.

A flat-flame nozzle 10 is included in a burner apparatus 12 of an oxygen-fuel combustion system 14 as suggested in FIGS. 1 and 2. Flat-flame nozzle 10 is modular and is formed to include interchangeable components that can be changed by technicians in the field as suggested in FIG. 4 to vary the flow velocity of fuel 16 flowing through the nozzle 10 to allow the fired capacity to be adjusted in the field after installation of burner assembly 12 at an industrial plant. A flat-flame nozzle 110 configured to conduct oxygen 18 and fuel 16 and to be adjusted in the field to vary flow rates of fuel 16 and of oxygen 18 is shown in FIGS. 12-16, while another field-adjustable oxygen-fuel flat-flame nozzle 210 is shown in FIGS. 17-21.

Burner apparatus 12 includes a nozzle-support fixture 20 coupled to a burner block 22 formed to include a flame chamber 24 as suggested in FIGS. 1 and 2. Flat-flame nozzle 10 is mounted on nozzle-support structure 20 as suggested in FIG. 1 and arranged to extend into flame chamber 24.

In use, fuel 16 from fuel supply 16S is caused to flow in flat-flame nozzle 10 and exit into flame chamber 24 through a fuel-discharge outlet 34 formed in flat-flame nozzle 10 as suggested in FIG. 1. Oxygen 18 from oxygen supply 18S is discharged into an oxygen-supply housing 26 provided in nozzle-support fixture 20 and caused to move through an oxygen-flow passageway 28 interconnecting an interior region 26I of oxygen-supply housing 26 and flame chamber 24 and containing a downstream portion of flat-flame nozzle 10 as suggested in FIG. 1. Fuel 16 discharged from flat-flame nozzle 10 mixes with oxygen 18 discharged from oxygen-flow passageway 28 to produce a combustible oxygen-fuel mixture 19 which is ignited in flame chamber 24 to produce a flat flame 30 as suggested in FIGS. 1 and 2.

Flat-flame nozzle 10 includes a fluid conductor 32 configured to conduct fuel 16 therethrough. Fluid conductor 32 is formed to include a downstream fuel-discharge outlet 34 and a fuel-inlet pipe 36 coupled to an upstream portion of fuel conductor 32 as shown, for example, in FIG. 3. Fluid conductor 32 is formed to include an upstream fuel-receiving plenum 56 and a downstream fuel-transport passageway 37 interconnecting fuel-receiving plenum 56 and fuel-discharge outlet 34 as suggested in FIG. 1. Fuel-inlet pipe 36 is adapted to be coupled to fuel supply 16S via any suitable supply line 16L as suggested in FIGS. 1 and 2 and is configured to discharge fuel 16 into fuel-receiving plenum of fuel conductor 32.

Figure 4:
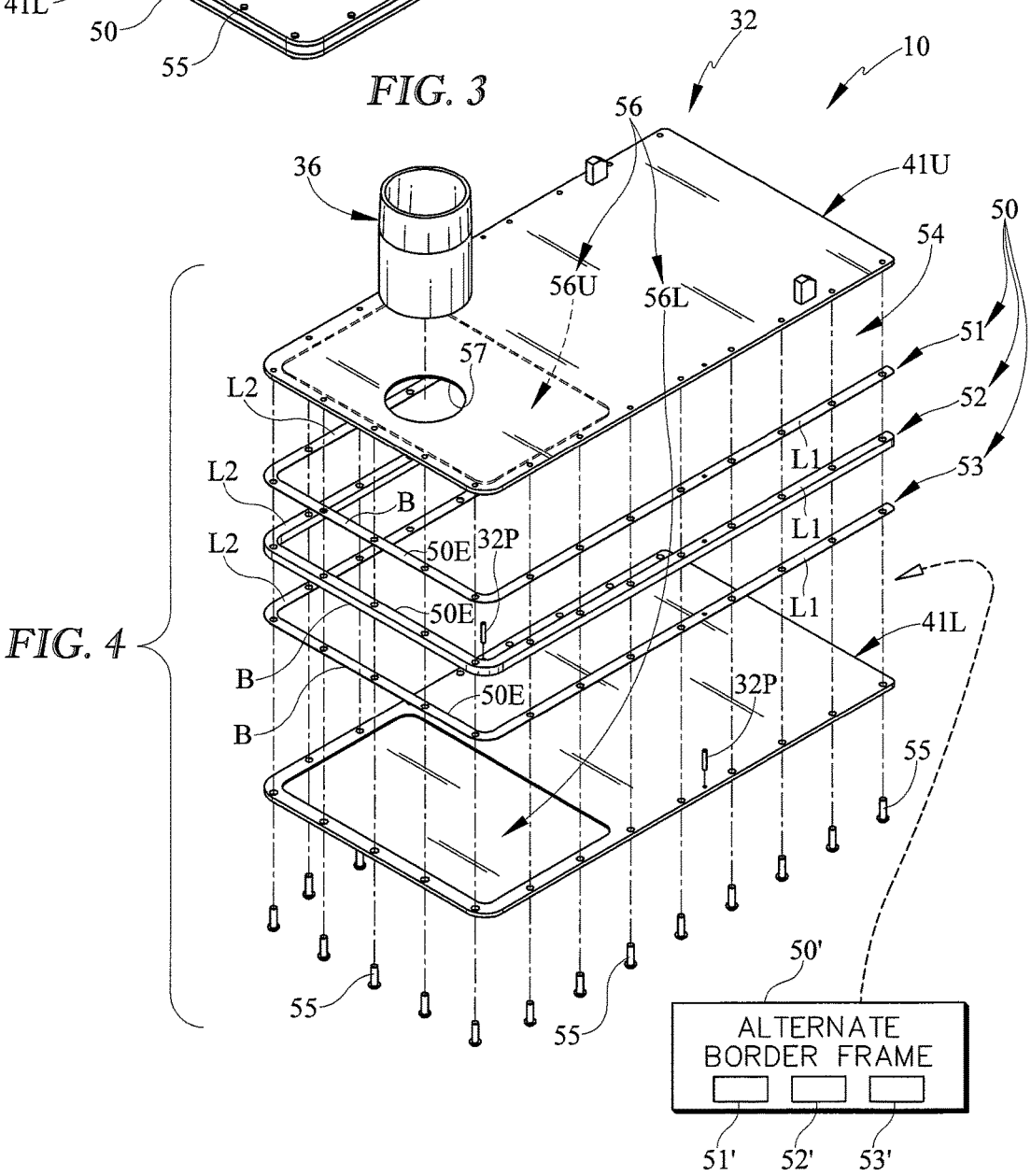
FIG. 4 is an exploded perspective assembly view of components that cooperate to form the flat-flame nozzle of FIG. 3 showing a first lower plate, a top cover including a first upper plate and a fuel-inlet pipe coupled to an upstream end of the first upper plate, an unassembled removable first plate-separation border frame arranged to lie between the first lower plate and the first upper plate and defined by a thin U-shaped top gasket, a relatively thicker U-shaped separator strip, and a thin U-shaped bottom gasket, and fasteners for retaining the plates and border frame in stationary positions relative to one another to form the flat-flame nozzle.

Fluid conductor 32 of flat-flame nozzle 10 includes a first lower plate 41L, a first upper plate 41U, and a removable (and thus replaceable) first plate-separation border frame 50 comprising a thin U-shaped top gasket 51, a relatively thicker U-shaped separator strip 52, and a thin U-shaped bottom gasket 53 as shown, for example, in FIG. 4. Upstanding alignment pins 32P pass through apertures formed in components 41L, 41U and 51-53 as suggested in FIG. 4 to align the components with one another before they are fastened together using fasteners 55.

Figure 3:
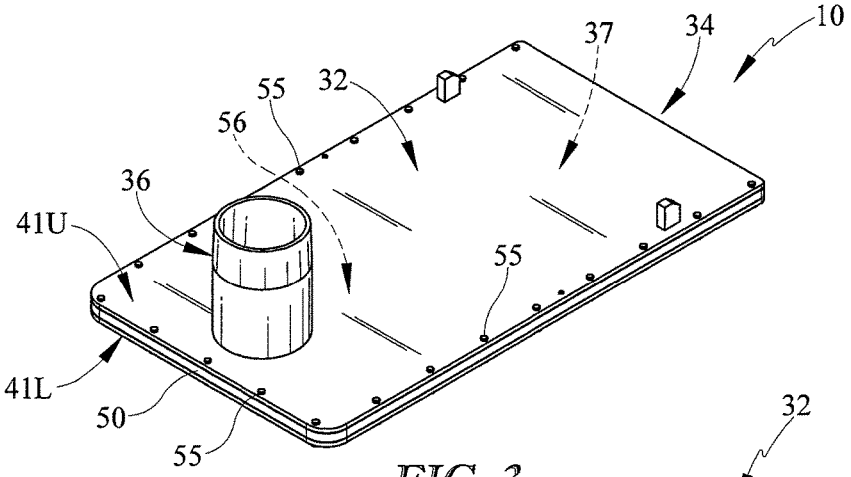
FIG. 3 is a perspective view of the flat-flame nozzle of FIGS. 1 and 2.

Fasteners 55 are passed through companion fastener-receiving apertures formed in each of plates 41L, 41U and border frame components 51, 52, 53 as suggested in FIGS. 3 and 4 to retain removable first plate-separation border frame 50 in a stationary position between first lower plate 41L and first upper plate 41U to form fuel-discharge outlet 34 and a fuel-transport passageway 37 communicating with fuel-discharge outlet 34, and an upstream fuel-receiving plenum 56 communicating with fuel-inlet pipe 36 and downstream fuel-transport passageway 37. The fasteners 55 can be removed by a technician in the field working on a burner apparatus 12 that has been installed in an industrial plant to replace removable first plate-separation border frame 50 with a relatively thicker or thinner removable alternate first plate-separation border frame 50' as suggested diagrammatically in FIG. 4. Such a modification can be made to change the fired capacity of burner assembly 12 in the field after installation at the option of the user.

Figure 5:
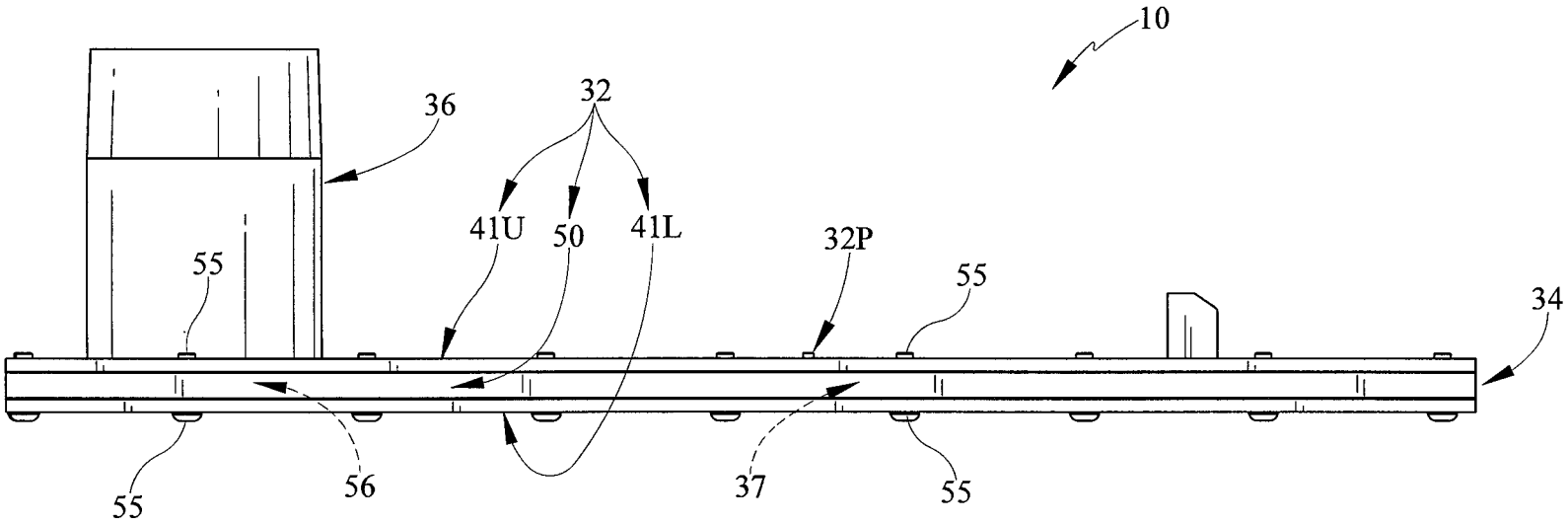
FIG. 5 is an enlarged side elevation view of the flat-flame nozzle of FIGS. 1-3 showing an upstream end on the left and a downstream end on the right.
Figure 6:
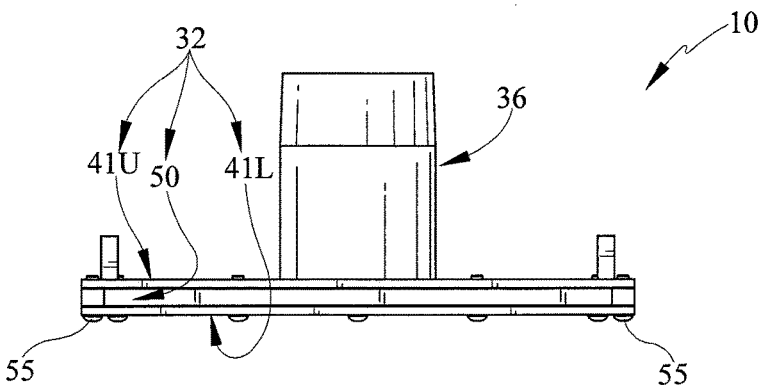
FIG. 6 is an end elevation view of the nozzle of FIG. 5 showing a rectangle-shaped fuel-discharge outlet formed in the downstream end of the flat-flame nozzle of FIG. 5.
Figure 7:
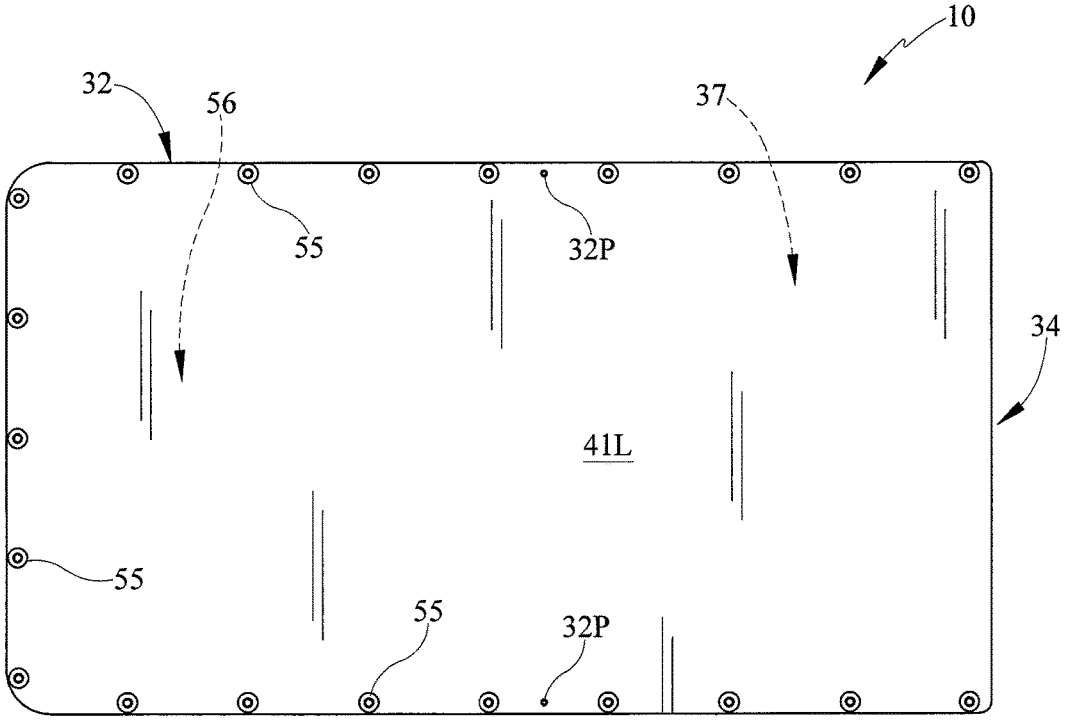
FIG. 7 is a bottom view of the flat-flame nozzle of FIG. 5.
Figure 10:
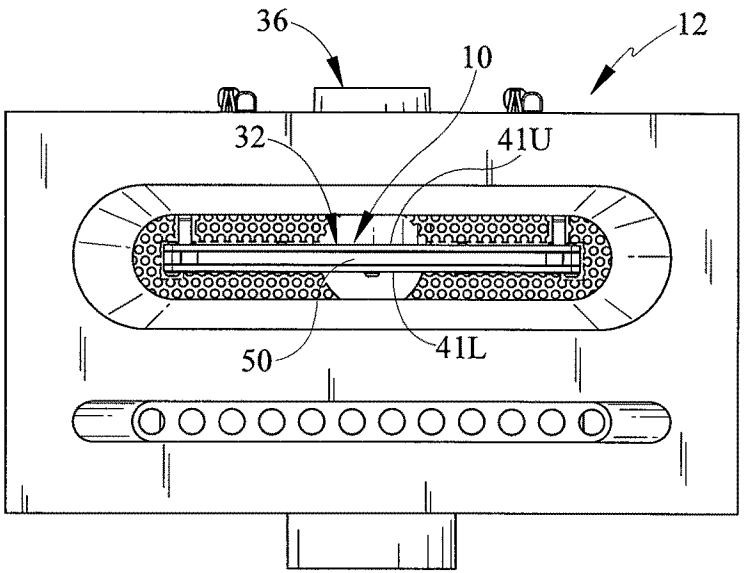
FIG. 10 is a view of a downstream end of the oxygen-fuel burner unit of FIG. 8.
Figure 11:
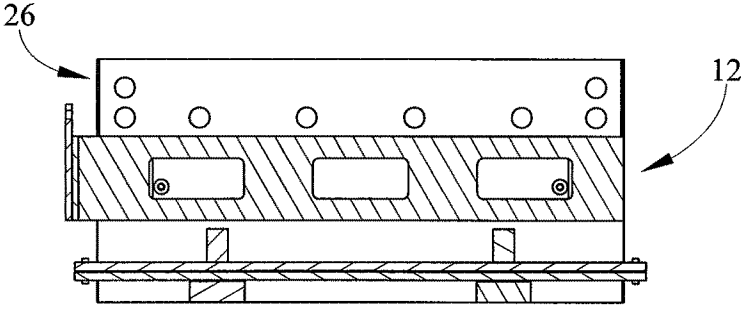
FIG. 11 is an enlarged view taken along line 11-11 of FIG. 1 showing a series of three rectangle-shaped oxygen-admission inlets and eight round oxygen-admission inlets formed in a bottom wall of the oxygen-supply housing through which oxygen passes to enter the oxygen-flow passageway formed in the oxygen-supply housing to surround the flat-flame nozzle.
Figure 8:
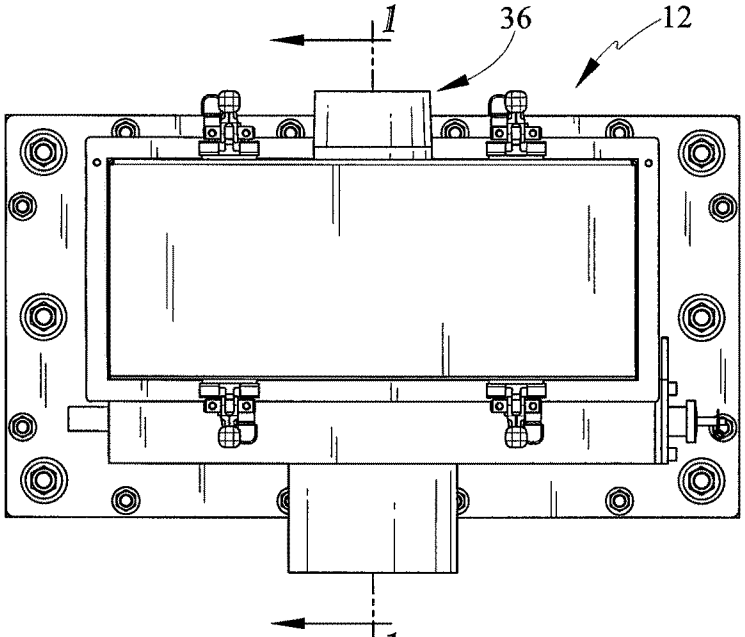
FIG. 8 is a view of an upstream end of the oxygen-fuel burner unit of FIGS. 1 and 2.
Figure 9:
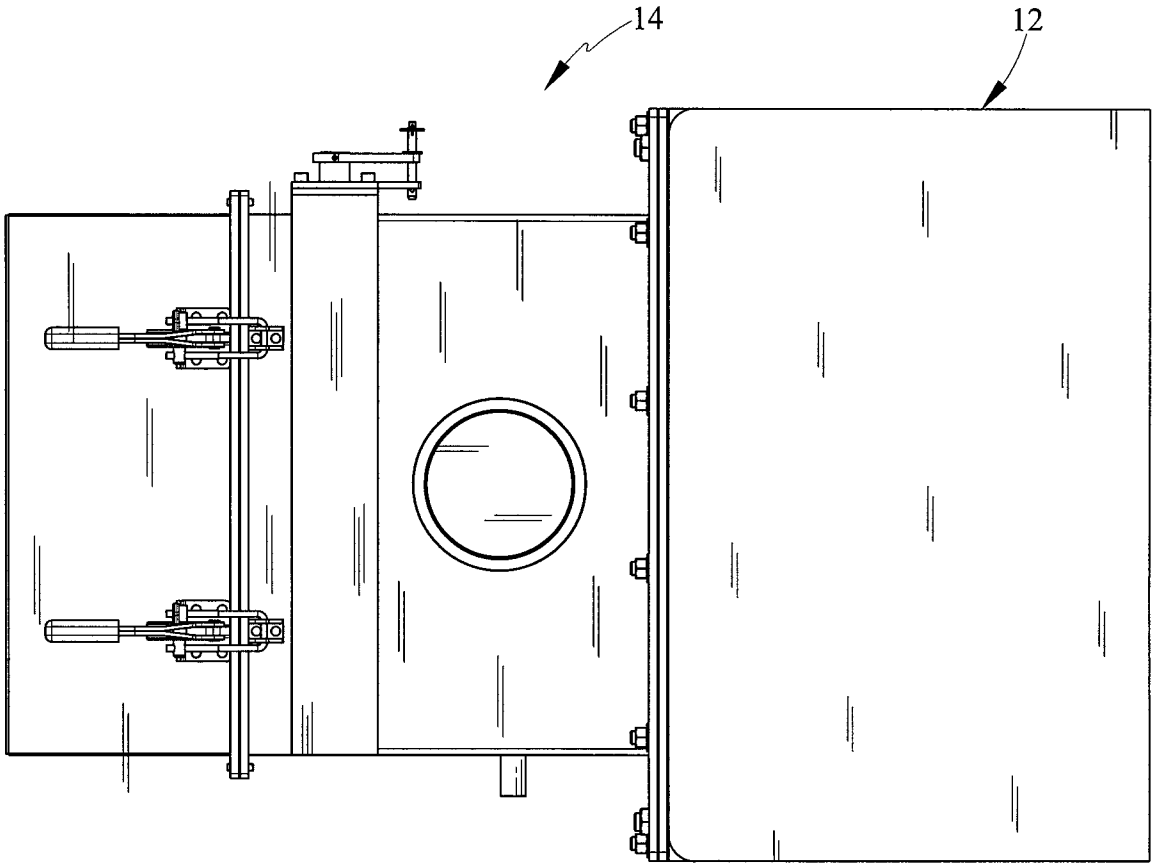
FIG. 9 is a top plan view of the oxygen-fuel burner unit of FIG. 8.

A burner apparatus 12 comprises a flat-flame nozzle 10 configured to conduct fuel 16 and to provide means for generating a flat flame 30 when fuel 16 conducted by the flat-flame nozzle 10 is exposed to oxygen 18 to produce an oxygen-fuel mixture that is ignited as suggested in FIG. 1. Flat-flame nozzle 10 is formed to include a fuel-discharge outlet 34 and a fuel-transport passageway 37 communicating with fuel-discharge outlet 34 as shown, for example, in FIGS. 1 and 5. Flat-flame nozzle 10 includes a first lower plate 41L, a first upper plate 41U, and a removable first plate-separation border frame 50 interposed between first lower plate 41L and first upper plate 41U as suggested in FIGS. 3 and 4. Removable first plate-separation border frame 50 is configured to cooperate with first lower plate 41L and first upper plate 41U to form fuel-discharge outlet 34 and fuel-transport passageway 37 as suggested in FIG. 4.

Flat-flame nozzle 10 also includes fastener means for releasably retaining the removable first plate-separation border frame 50 in a stationary position between first lower plate 41L and first upper plate 41U to establish a first flow velocity of fuel 16 flowing through fuel-transport passageway 37 toward fuel-discharge outlet 34 and for allowing replacement of the removable first plate-separation border frame 50 with a removable alternate first plate-separation border frame 50' of a different thickness to establish a different second flow velocity of fuel 16 flowing through fuel-transport passageway 37 toward fuel-discharge outlet 34 as suggested diagrammatically in FIG. 4. A technician can exchange border frames in the field to change the fired capacity of burner apparatus 12 easily after installation.

Removable first plate-separation border frame 50 is configured to include a first separator strip 52 having a first thickness, a bottom gasket 53 positioned to lie between first lower plate 41L and first separator strip 52, and a top gasket 51 positioned to lie between first upper plate 41U and first separator strip 52. First separator strip 52 is made of stainless steel and each of bottom and top gaskets 51, 53 is made of copper in an illustrative embodiment.

Removable alternate first plate-separation border frame 50' is configured to occupy a space between first lower plate 41L and first upper plate 41U vacated by the removable first plate-separation border frame 50 to establish the different second flow velocity of fuel 16 flowing through fuel-transport passageway 37 toward fuel-discharge outlet 34 as suggested diagrammatically in FIG. 4. Removable alternate first plate-separation border frame 50' is configured to include a second separator strip 52' having a different second thickness, a bottom gasket 53' positioned to lie between first lower plate 41L and second separator strip 52', and a top gasket 51' positioned to lie between first upper plate 41U and second separator strip 52' as suggested diagrammatically in FIG. 4.

The fastener means includes several fasteners 55 and each of the fasteners 55 extends through a companion fastener-receiving aperture formed in each of the first lower plate 41L, bottom gasket 53, first separator strip 52, top gasket 51, and first upper plate 41U as suggested in FIG. 4. Each of the first lower plate 41L and the first upper plate 41U is rectangular and has perimeter portions formed to include the fastener-receiving apertures. Each of first separator strip 52 and bottom and top gaskets 53, 51 is U-shaped and arranged to cause an open end thereof to establish a portion of the fuel-discharge outlet 54 as suggested in FIG. 4.

First upper plate 41U is formed to include a shallow upper recess 56U facing toward first lower plate 41L and arranged to lie in spaced-apart relation to fuel-discharge outlet 34 to locate fuel-transport passageway 37 therebetween as suggested in FIGS. 1 and 4. First lower plate 41L is formed to include a shallow lower recess 56L facing toward first upper plate 41U and cooperating with shallow upper recess 56U and an inner edge 50E of one of the removable first plate-separation border frame 50 and the removable alternate first plate-separation border frame 50' to form a fuel-receiving plenum 56 as suggested in FIGS. 1 and 4. Fuel-receiving plenum 56 is configured to provide fuel distribution means for collecting fuel 16 admitted into the shallow upper recess 56U and distributing collected fuel 16 into fuel-transport passageway 37 for downstream movement toward fuel-discharge outlet 34 and fuel-transport passageway 37 is arranged to conduct fuel 16 discharged from fuel-receiving plenum 56 to fuel-discharge outlet 34 as suggested in FIG. 1.

First upper plate 41U includes an exterior surface facing away from first lower plate 41L and an interior surface facing toward first lower plate 41L and defining boundary portions of the shallow upper recess 56U and fuel-transport passageway 37 as suggested in FIGS. 1 and 4. First upper plate 41U is formed to include a fuel-admission port 57 as shown, for example, in FIG. 4. Fuel-admission port 57 has an inlet formed in the exterior surface of first upper plate 41U and an outlet formed in the interior surface of first upper plate 41U to open into the shallow upper recess 56U. Fuel-inlet pipe 36 is coupled to first upper plate 41U at the fuel-admission port and configured to conduct fuel 16 into the shallow upper recess 56U for subsequent movement through fuel-transport passageway 37 to and through fuel-discharge outlet 34 as suggested in FIGS. 1, 3, and 4.

As suggested in FIG. 4, each of the first separator strip 52 and the bottom and top gaskets 53, 51 includes a first leg L1, a second leg L2 arranged to lie in spaced-apart relation to first leg L1, and a bight portion B arranged to interconnect upstream ends of first and second legs L1, L2 and lie in spaced-apart relation to fuel-transport passageway 37. Shallow lower recess 56L is located between each of the bight portions B and fuel-transport passageway 37 and between each of the first legs L1 and each of the second legs L2.

Figure 12:
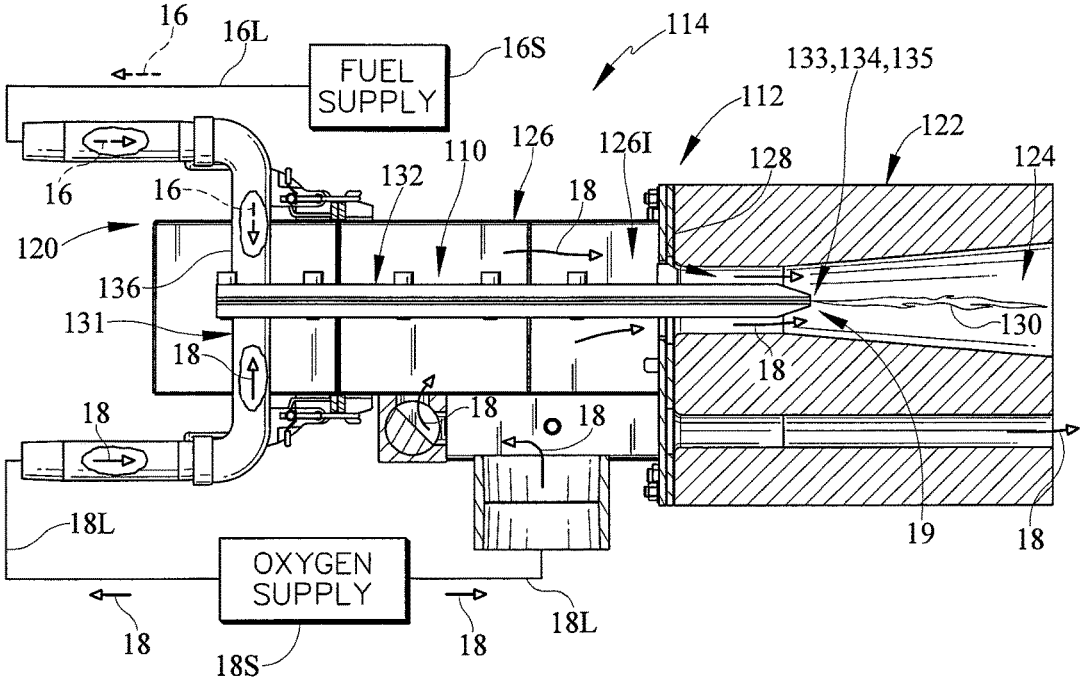
FIGS. 12-16 show a flat-flame nozzle made in accordance with a second embodiment of the present disclosure to conduct fuel and oxygen along separate paths through the oxygen-fuel flat-flame nozzle into a flame chamber.
Figure 13:
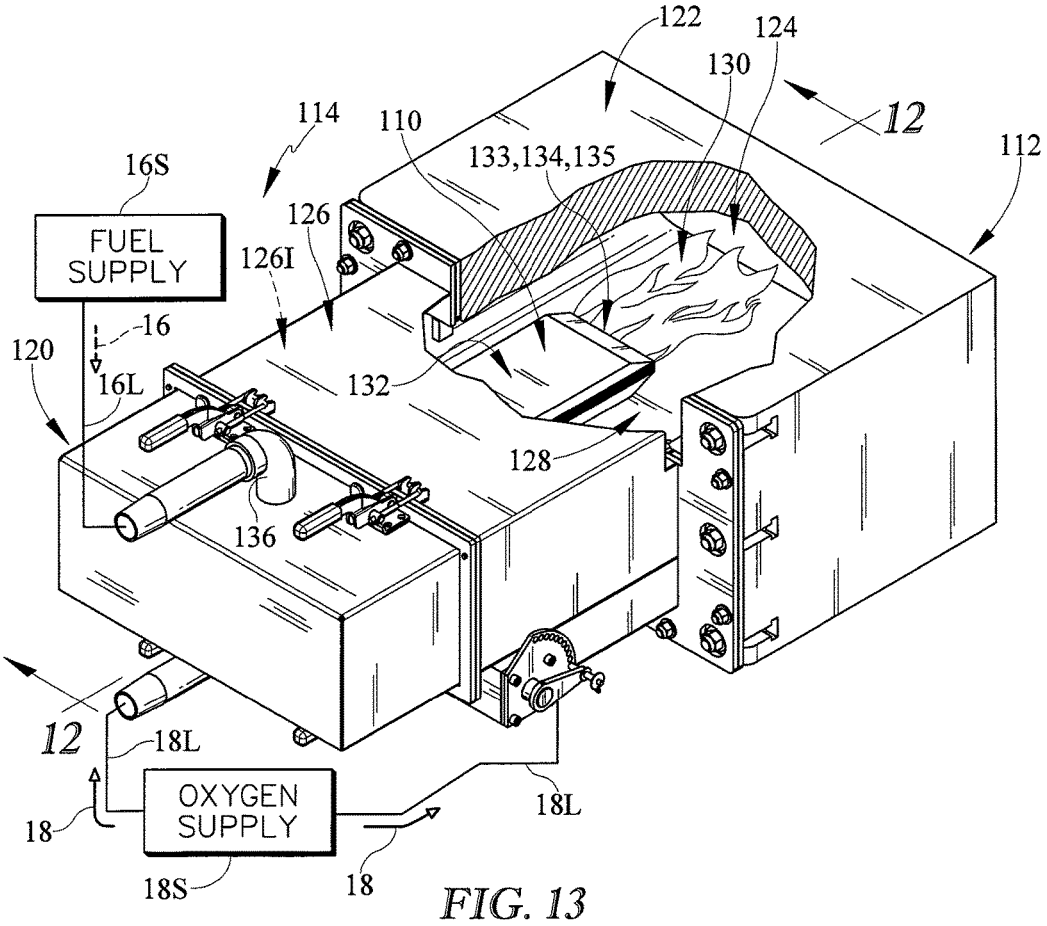

A flat-flame nozzle 110 in accordance with a second embodiment of the present disclosure is included in a burner apparatus 112 of an oxygen-fuel combustion system 114 as suggested in FIGS. 12 and 13. It is within the scope of the present disclosure to use oxygen-fuel flat-flame nozzle 110 by itself apart from the rest of burner apparatus 112 as suggested in FIG. 14.

A burner apparatus 112 comprises a flat-flame nozzle 110 configured to conduct fuel 16 and oxygen 18 and to provide means for generating a flat flame 130 when fuel and oxygen conducted by flat-flame nozzle 110 is mixed to produce an oxygen-fuel mixture 19 that is ignited. Oxygen-fuel flat-flame nozzle 110 is modular and is formed to include interchangeable components that can be changed by technicians in the field as suggested in FIG. 15 to vary the flow velocity of fuel 16 and oxygen 18 flowing through the flat-flame nozzle 110 to allow the fired capacity to be adjusted in the field after installation. Flat-flame nozzle 110 is formed to include a fuel-transport passageway 137 conducting fuel 16, a lower oxygen-transport passageway 138 conducting oxygen 18, and an upper oxygen-transport passageway 139 conducting oxygen 18 as suggested in FIGS. 16 and 16A.

Burner apparatus 112 includes a nozzle-support fixture 120 coupled to a burner block 122 formed to include a flame chamber 124 as suggested in FIGS. 12 and 13. Oxygen-fuel flat-flame nozzle 110 is mounted on nozzle-support fixture 120 as suggested in FIG. 12 and arranged to extend into flame chamber 124.

In use, fuel 16 from fuel supply 16S and oxygen 18 from oxygen supply 18S are caused to flow in oxygen-fuel flat-flame nozzle 110 and exit into flame chamber 124 through separate fuel and oxygen discharge outlets formed in oxygen-fuel flat-flame nozzle 110 as suggested in FIGS. 12 and 13. Oxygen-fuel flat-flame nozzle 110 is formed to include lower oxygen-discharge outlet 133, fuel-discharge outlet 134, and upper oxygen-discharge outlet 135 as shown, for example, in FIG. 14A.

Oxygen 18 from oxygen supply 18S is also discharged into an oxygen-supply housing 126 provided in nozzle-support fixture 120 to move through an oxygen-flow passageway 128 interconnecting an interior region 126I of oxygen-supply housing 126 and flame chamber 124 and containing a downstream portion of oxygen-fuel flat-flame nozzle 110 as suggested in FIG. 12. Fuel 16 discharged from flat-flame nozzle 110 mixes with oxygen 18 discharged from lower oxygen-discharge outlet 133 and upper oxygen-discharge outlet 135 and with oxygen 18 discharged from oxygen-flow passageway 128 to produce a combustible oxygen-fuel mixture 19 which is ignited in flame chamber 124 to produce a flat flame 130 as suggested in FIGS. 12 and 13.

Flat-flame nozzle 110 includes a fluid conductor 132 configured to conduct fuel and oxygen therethrough. Fluid conductor 132 is formed to include a downstream fuel-discharge outlet 134 and a fuel-inlet pipe 136 coupled to an upstream portion of fluid conductor 132 as shown, for example, in FIG. 14. Fuel-inlet pipe 136 is adapted to be coupled to fuel supply 16S via any suitable supply line 16L as suggested in FIGS. 12 and 13. Fluid conductor 132 is also formed to include an oxygen-inlet pipe 131 coupled to an upstream end of fluid conductor 132 as shown in FIGS. 15 and 16.

Figure 15:
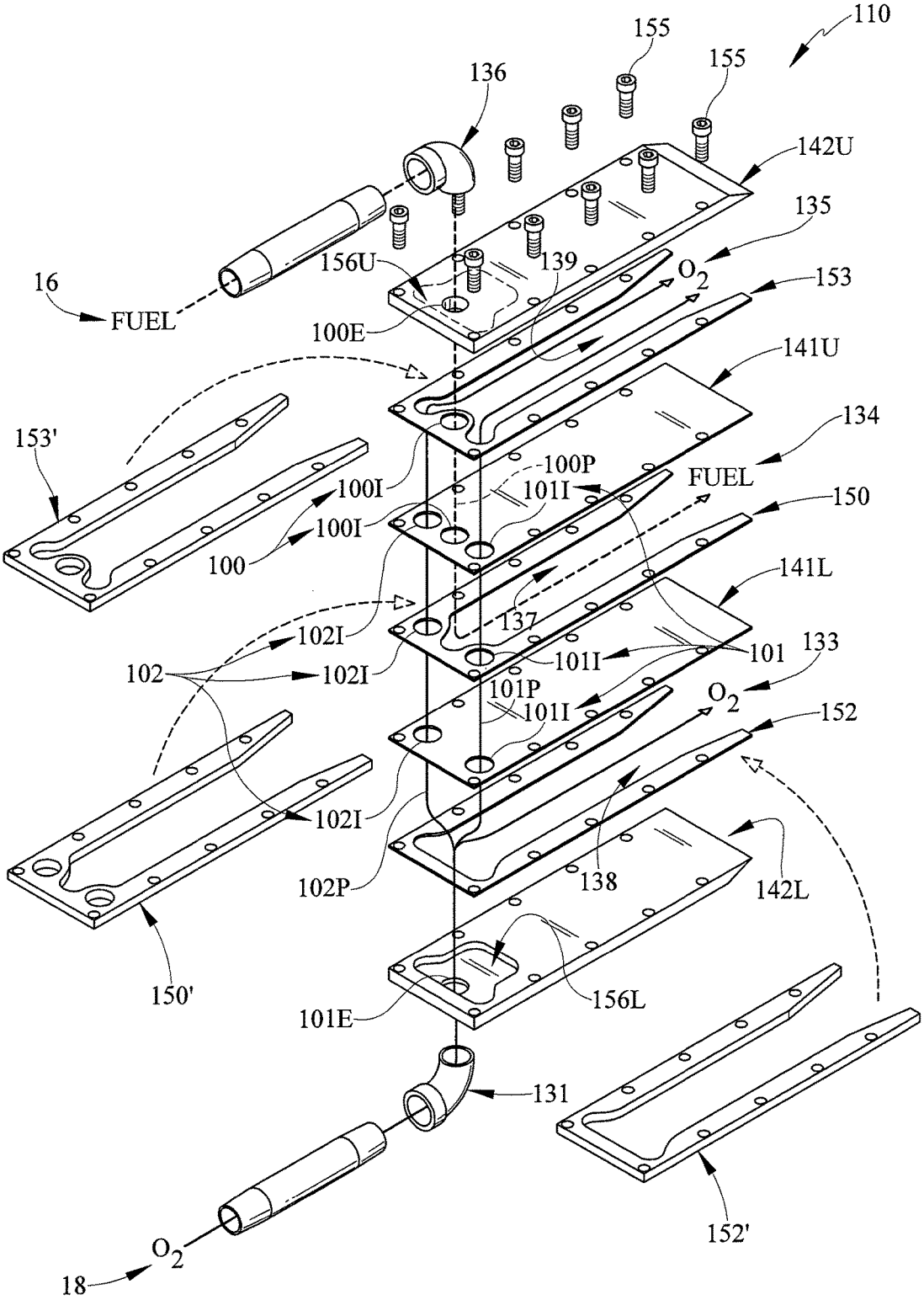
Figure 16A:
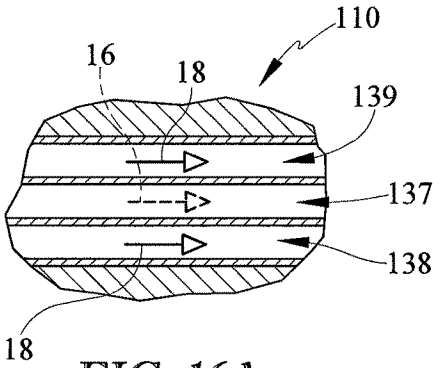
FIG. 16A is an enlarged sectional view taken in the circled region shown in FIG. 16 to show that the oxygen-fuel flat-flame nozzle is formed to include a lower oxygen-transport passageway, a (middle) fuel-transport passageway, and an upper oxygen-transport passageway.
Figure 16:
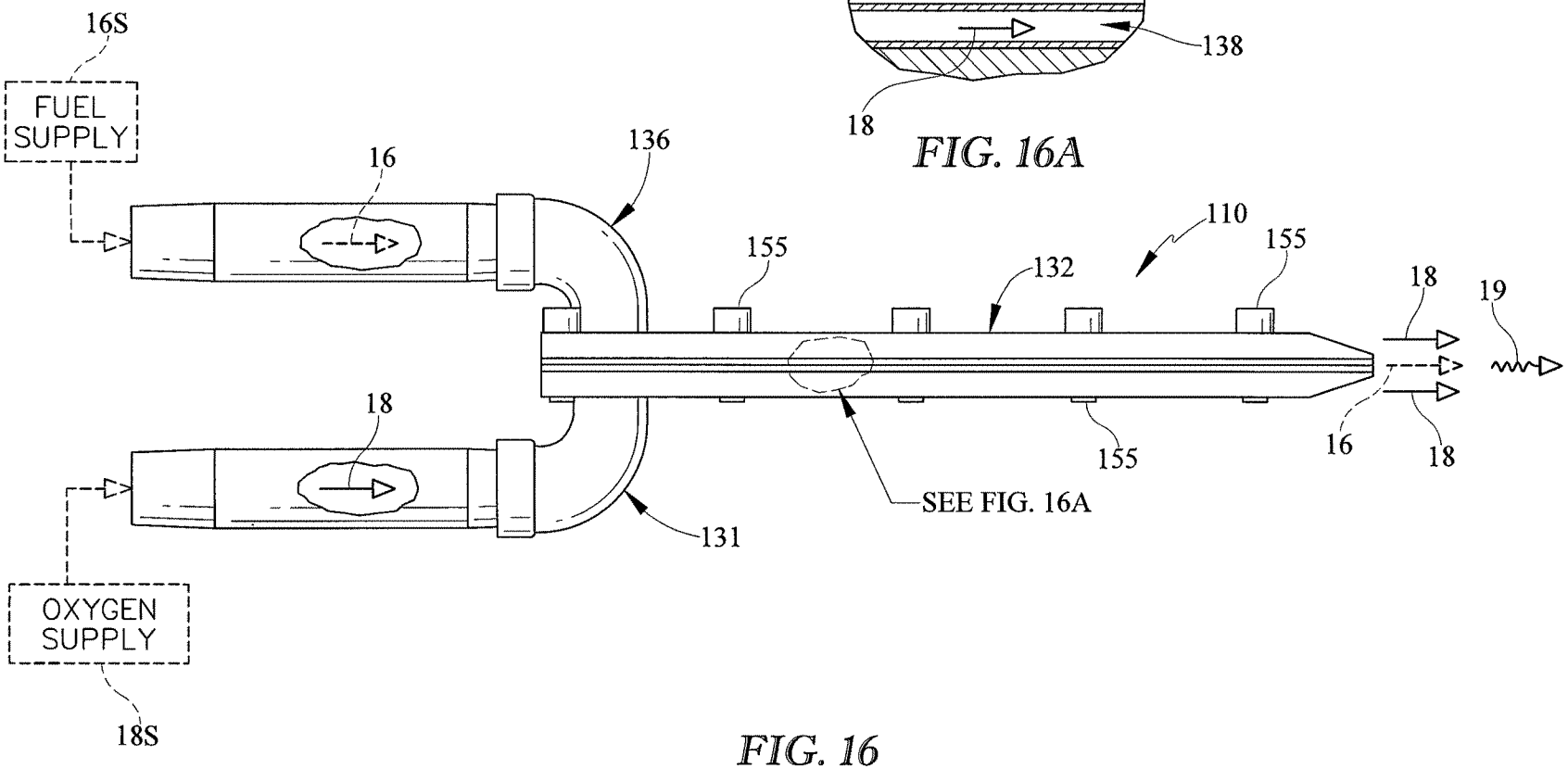

Fluid conductor 132 of oxygen-fuel flat-flame nozzle 110 is shown in FIG. 15 to include (from bottom to top) a second lower plate 142L, a removable second plate-separation border frame 152, a first lower plate 141L, a removable first plate-separation border frame 150, a first upper plate 141U, a removable third plate-separation border frame 153, and a second upper plate 142U. Fasteners 155 can be used to hold all of these components together to produce fluid conductor 132. A collection of three alternate border frames 152', 150', and 153' is provided for technicians to use in the field as replacements for border frames 152, 150, and 153 in accordance with the present disclosure to change the firing capacity of burner apparatus 112 as suggested in FIG. 15.

Each of border frames 152, 150, and 153 (and alternate border frames 152', 150', and 153') comprises a U-shaped separator strip, a U-shaped top gasket, and a U-shaped bottom gasket as disclosed in the embodiment of FIGS. 1-11. The thickness of each border frame can be varied by, for example, varying the thickness of the separator strip.

Flat-flame nozzle 110 also includes fastener means comprising several fasteners 155 for releasably retaining the removable first plate-separation border frame 150 in a stationary position between first lower plate 141L and first upper plate 141U to establish a first flow velocity of fuel 16 flowing through fuel-transport passageway 137 toward fuel-discharge outlet 134 and for allowing replacement of the removable first plate-separation border frame 150 with a removable alternate first plate-separation border frame 150' of a different thickness to establish a different second flow velocity of fuel 16 flowing through fuel-transport passageway 137 toward fuel-discharge outlet 134 as suggested in FIG. 15. Removable alternate first plate-separation border frame 150' is configured to occupy a space between first lower plate 141L and first upper plate 141U vacated by removable first plate-separation border frame 150 to establish the different second flow velocity of fuel 16 flowing through fuel transport passageway 137 toward fuel-discharge outlet 134 as suggested in FIG. 15. A technician can exchange border frames in the field to change the fired capacity of burner apparatus 112 easily after installation.

Figures 14, 14A:
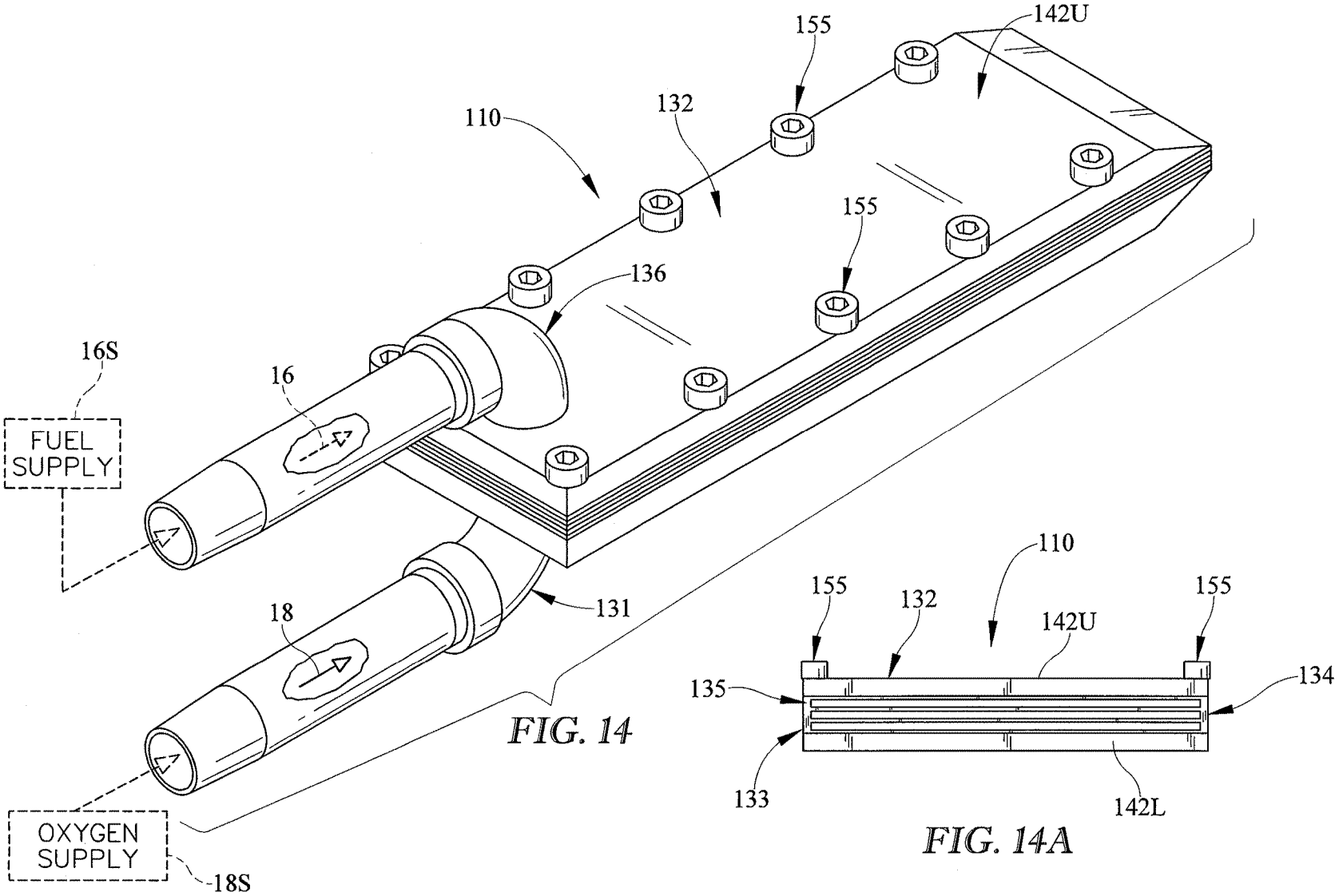
FIG. 14A is an end elevation view of the downstream end of the oxygen-fuel flat-flame nozzle of FIG. 14 showing in sequence (bottom to top) a rectangular lower oxygen-discharge outlet, a rectangular fuel-discharge outlet, and a rectangular upper oxygen-discharge outlet.

Fasteners 155 are passed through companion fastener-receiving apertures formed in each of plates 142L, 141L, 141U, and 142U and border frames 151, 152, and 153 as suggested in FIGS. 14 and 15 to retain the border frames 151-153 in fixed positions relative to the plates 142L, 141L, 141U, and 142U as suggested in FIG. 15. Fasteners 155 can be removed by a technician in the field to replace removable first plate-separation border frame 150 with a relatively thicker or thinner removable alternate first plate-separation border frame 150' as suggested diagrammatically in FIG. 15. Similarly, border frame 152' can replace border frame 152 and border frame 153' can replace border frame 153. Such a modification can be made to change the fired capacity of burner 112 to be changed in the field by changing fuel and/or oxygen velocity flow rates in oxygen-fuel flat-flame nozzle 110 after installation at the option of the user.

Oxygen-fuel flat-flame nozzle 110 is also formed to include a lower oxygen-discharge outlet 133 and a lower oxygen-transport passageway 138 communicating with lower oxygen-discharge outlet 133 as suggested in FIGS. 14A, 15, and 16. Flat-flame nozzle 110 also includes a second lower plate 142L and a removable second plate-separation border frame 152 interposed between the first and second lower plates 141L, 142L and configured to cooperate therewith to form lower oxygen-discharge outlet 133 and lower oxygen-transport passageway 138. The fastener means is configured to provide means for releasably retaining the removable second plate-separation border frame 152 in a stationary position between first and second lower plates 141L, 142L to establish a first flow velocity of oxygen 18 flowing through lower oxygen-transport passageway 138 toward lower oxygen-discharge outlet 133 and for allowing replacement of the removable second plate-separation border frame 152 with a removable alternate second plate-separation border frame 152' of a different thickness to establish a different second flow velocity of oxygen 18 flowing through lower oxygen-transport passageway 138 toward lower oxygen-discharge outlet 133. Removable alternate second plate-separation border frame 152' is configured to occupy a space between first and second lower plates 141L, 142L vacated by removable second plate-separation border frame 152 to establish the different second flow velocity of oxygen 18 flowing through lower oxygen-transport passageway 138 toward lower oxygen-discharge outlet 133.

Oxygen-fuel flat-flame nozzle 110 is also formed to include an upper oxygen-discharge outlet 135 and an upper oxygen transport passageway 139 communicating with upper oxygen-discharge outlet 135 as suggested in FIGS. 14A, 15, and 16. Flat-flame nozzle 110 also includes a second upper plate 142U and a removable third plate-separation border frame 153 interposed between first and second upper plates 141U, 142U and configured to cooperate therewith to form upper oxygen-discharge outlet 135 and upper oxygen-transport passageway 139. The fastener means is configured to provide means for releasably retaining the removable third plate-separation border frame 153 in a stationary position between first and second upper plates 141U, 142U to establish a first flow velocity of oxygen 18 flowing through upper oxygen-transport passageway 139 toward upper oxygen-discharge outlet 135 and for allowing replacement of the removable third plate-separation border frame 153 with a removable alternate third plate-separation border frame 153' of a different thickness to establish a different second flow velocity of oxygen 18 flowing through upper oxygen-transport passageway 139 toward upper oxygen-discharge outlet 135. Removable alternate third plate-separation border frame 153' is configured to occupy a space between first and second upper plates 141U, 142U vacated by removable third plate-separation border frame 153 to establish the different second flow velocity oxygen 18 flowing through upper oxygen-transport passageway 139 toward upper oxygen-discharge outlet 135.

Second upper plate 142U is formed to include an exterior fuel-admission port 100E communicating with fuel-inlet pipe 136 as shown in FIG. 15. Each of the second upper plate 142U, removable third plate-separation border frame 153, and first upper plate 141U is formed to include an interior fuel-admission port 100I. Fuel-admission ports 100I are aligned with one another and cooperate to provide fuel conductor means 100 for conducting fuel 16 discharged into the exterior fuel-admission port 100E formed in second upper plate 142U along a path 100P into fuel-transport passageway 137 for subsequent movement through fuel-transport passageway 137 to and through fuel-discharge outlet 134 as suggested in FIG. 15. Second upper plate 142U is also formed to include a shallow upper recess 156U facing toward first upper plate 141U to cooperate with first upper plate 141U to form an oxygen-receiving plenum therebetween communicating with an upstream end of upper oxygen-transport passageway 135 as suggested in FIG. 15.

Second lower plate 142L is formed to include an exterior oxygen-admission port 101E communicating with oxygen-inlet pipe 131 and with the lower oxygen-transport passageway 138 as suggested in FIG. 15. Each of the first lower plate 141L, removable first plate-separation border frame 150, and first upper plate 141U is formed to include a first interior oxygen-admission port 101I. First interior oxygen-admission ports 101I are aligned with one another and cooperate to provide first oxygen conductor means 101 for conducting a first portion of the oxygen 16 discharged into the lower oxygen-transport passageway 138 through the exterior oxygen-admission port 101E formed in second lower plate 142L along a first path 101P into the upper oxygen-transport passageway 139 for subsequent movement through the upper oxygen-transport passageway 139 to and through the upper oxygen-discharge outlet 135 while a second portion of the oxygen 18 discharged into the lower oxygen-transport passageway 138 through the exterior oxygen-admission port 101E formed in second lower plate 142L flows through the lower oxygen-transport passageway 138 to and through the lower oxygen-discharge outlet 133 as suggested in FIG. 15. Second lower plate 142L is also formed to include a shallow lower recess 156L facing toward first lower plate 141L to cooperate with first lower plate 141L to form an oxygen-receiving plenum therebetween communicating with an upstream end of lower oxygen-transport passageway 133 as suggested in FIG. 15.

Each of the first lower plate 141L, removable first plate-separation border frame 150, and first upper plate 141U is formed to include a second interior oxygen-admission port 102I. Second interior oxygen-admission ports 102I are aligned with one another and cooperate to provide second oxygen conductor means 102 for conducting a third portion of the oxygen 18 discharged into the lower oxygen-transport passageway 138 through the exterior oxygen-admission port formed in second lower plate 142L along a separate second path 102P into the upper oxygen-transport passageway 139 for subsequent movement through the upper oxygen-transport passageway 139 to and through upper oxygen-discharge outlet 135. In an illustrative embodiment, interior fuel-admission port 100I is formed in first upper plate 141U to lie between interior oxygen-admission ports 101I, 102I as shown in FIG. 15.

Figure 17:
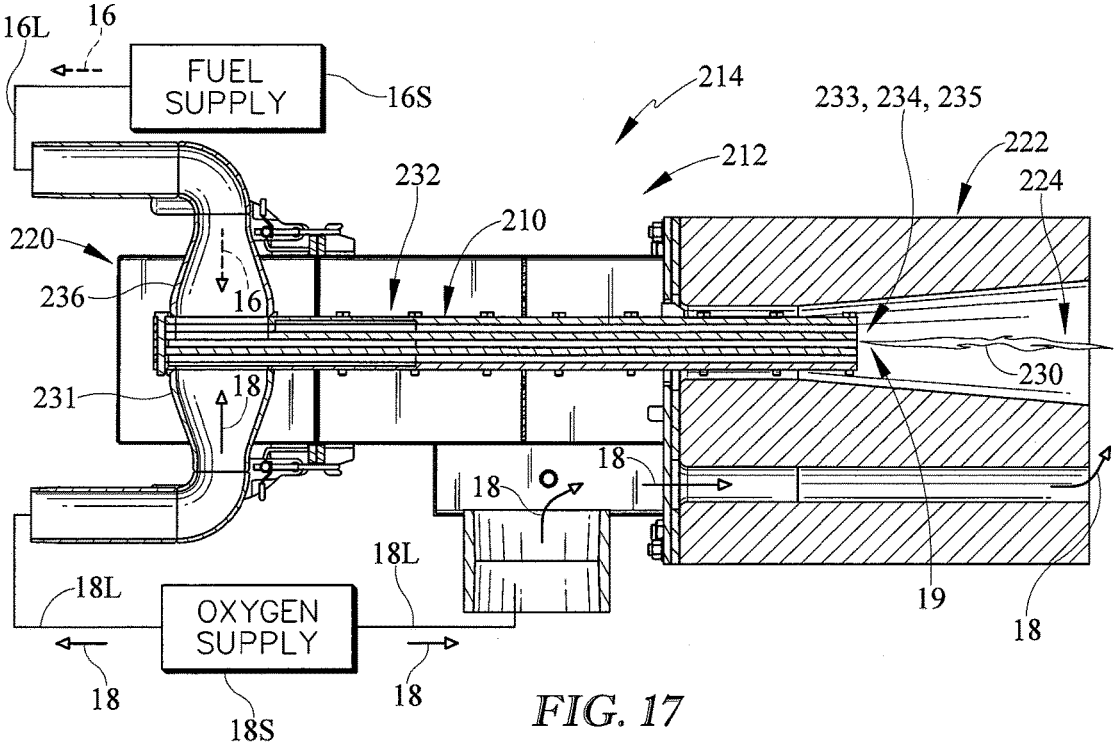
FIGS. 17-21 show an oxygen-fuel flat-flame nozzle made in accordance with a third embodiment of the present disclosure to conduct fuel and oxygen along separate paths into a flame chamber.
Figure 18:
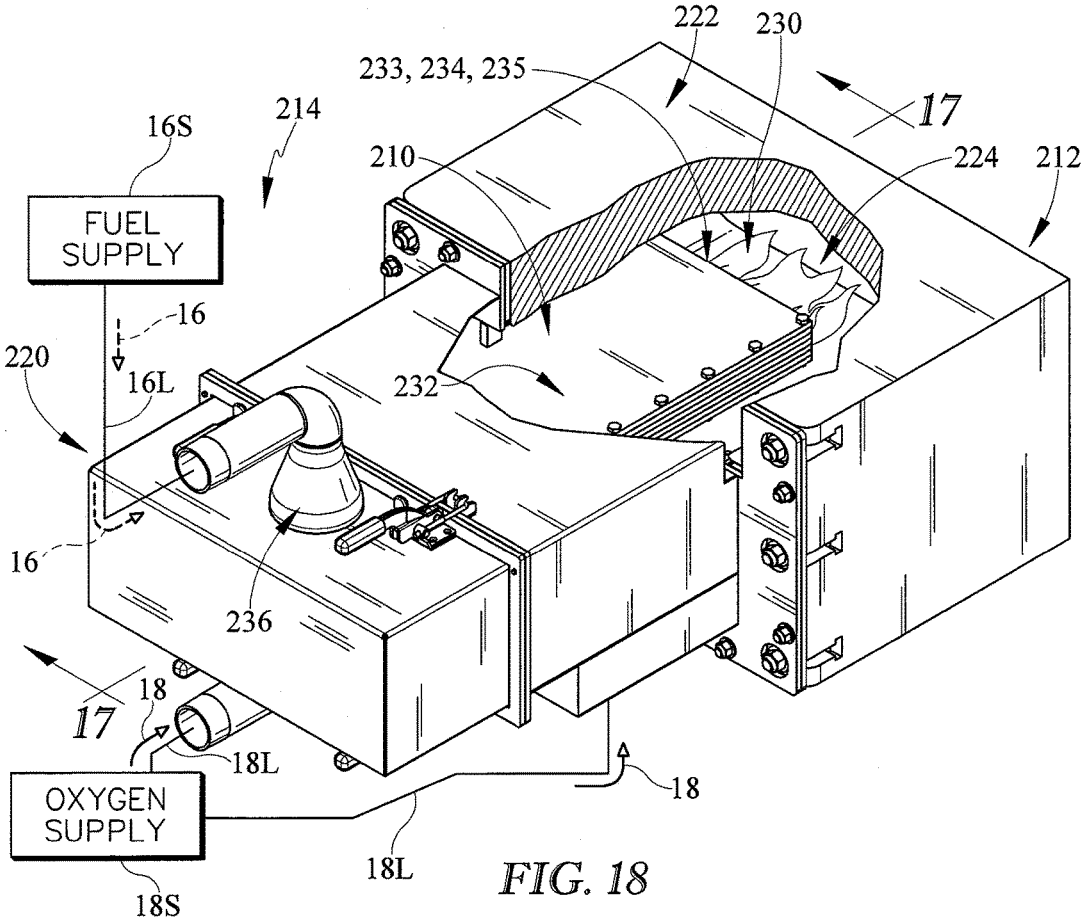

A flat-flame nozzle 210 in accordance with a third embodiment of the present disclosure is included in a burner apparatus 212 of an oxygen-fuel combustion system 214 as suggested in FIGS. 17 and 18. It is within the scope of the present disclosure to use oxygen-fuel flat-flame nozzle 210 by itself apart from the rest of burner apparatus 212 as suggested in FIG. 19.

A burner apparatus 212 comprises a flat-flame nozzle 210 configured to conduct fuel 16 and oxygen 18 and to provide means for generating a flat flame 230 when fuel and oxygen conducted by flat-flame nozzle 210 is mixed to produce an oxygen-fuel mixture 19 that is ignited as suggested in FIGS. 17 and 18. Oxygen-fuel flat-flame nozzle 210 is modular and is formed to include interchangeable components that can be changed by technicians in the field as suggested in FIG. 20 to vary the flow velocity of fuel 16 and oxygen 18 flowing through the flat-flame nozzle 210 to allow the fired capacity to be adjusted in the field after installation. Flat-flame nozzle 210 is formed to include a fuel-transport passageway 237 conducting fuel 16, a lower oxygen-transport passageway 238 conducting oxygen 18, and an upper oxygen-transport passageway 239 conducting oxygen 18 as suggested in FIGS. 21 and 21A.

Burner apparatus 212 includes a nozzle-support fixture 220 coupled to a burner block 222 formed to include a flame chamber 224 as suggested in FIGS. 17 and 18. Oxygen-fuel flat-flame nozzle 210 is mounted on nozzle-support fixture 220 as suggested in FIG. 17 and arranged to extend into flame chamber 224.

In use, fuel 16 from fuel supply 16S and oxygen 18 from oxygen supply 18S are caused to flow in oxygen-fuel flat-flame nozzle 210 and exit into flame chamber 224 through separate fuel and oxygen discharge outlets formed in oxygen-fuel flat-flame nozzle 210 as suggested in FIGS. 17 and 18. Oxygen-fuel flat-flame nozzle 210 is formed to include lower oxygen-discharge outlet 233, fuel-discharge outlet 234, and upper oxygen-discharge outlet 235 as shown, for example, in FIG. 19A. Fuel 16 discharged from flat-flame nozzle 110 mixes with oxygen 18 discharged from lower oxygen-discharge outlet 233 and upper oxygen-discharge outlet 235 to produce a combustible oxygen-fuel mixture 19 which is ignited in flame chamber 224 to produce a flat flame 230 as suggested in FIGS. 17 and 18.

Flat-flame nozzle 210 includes a fluid conductor 232 configured to conduct fuel 16 and oxygen 18 therethrough. Fluid conductor 232 is formed to include a downstream fuel-discharge outlet 234 and a fuel-inlet pipe 236 coupled to an upstream portion of fluid conductor 232 as shown, for example, in FIG. 19. Fuel-inlet pipe 236 is adapted to be coupled to fuel supply 16S via any suitable supply line 16L as suggested in FIGS. 17 and 18. Fluid conductor 232 is also formed to include an oxygen-inlet pipe 231 coupled to an upstream end of fluid conductor 232 as shown in FIGS. 20 and 21.

Figure 20:
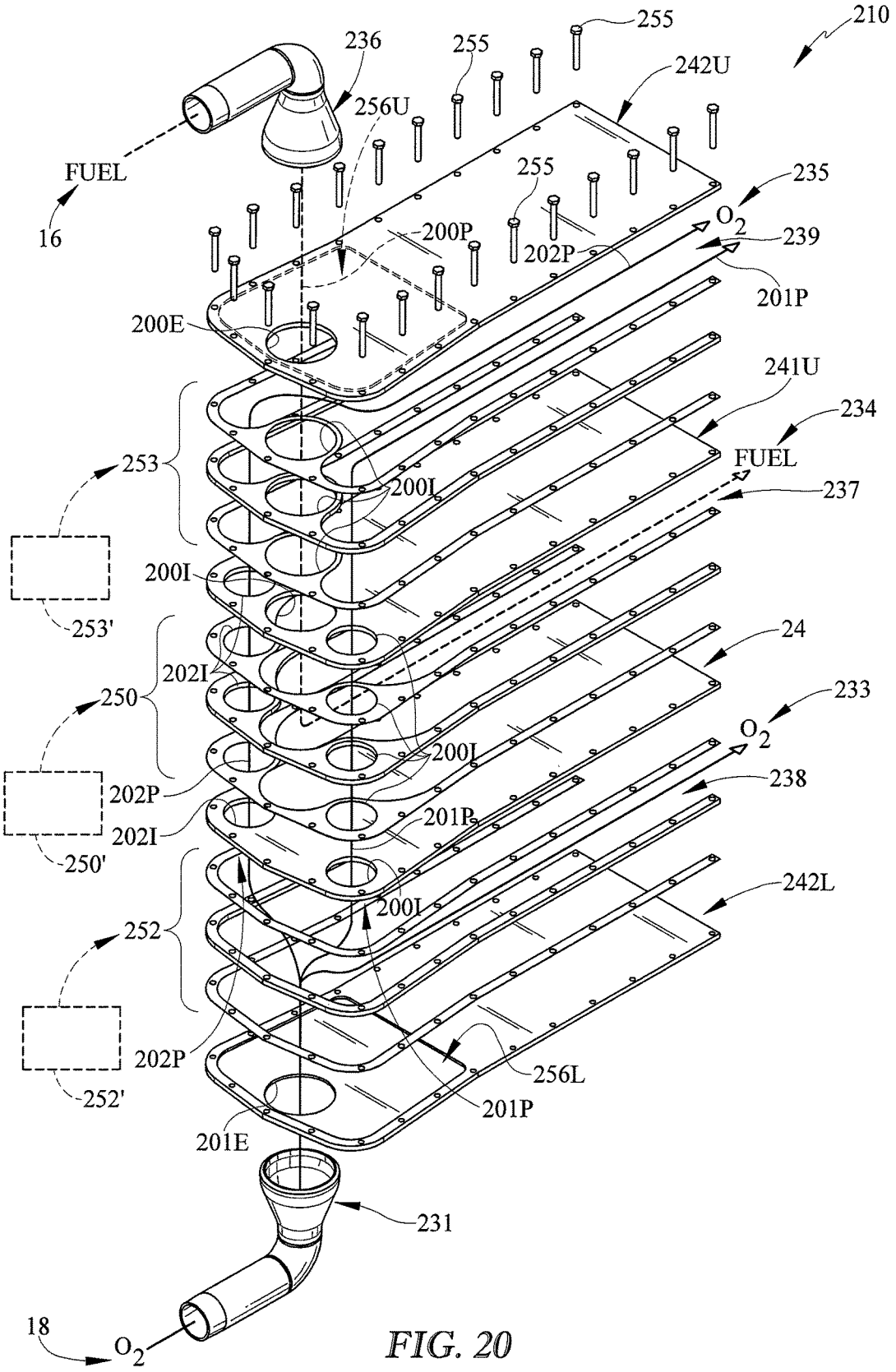
Figures 21, 21A:
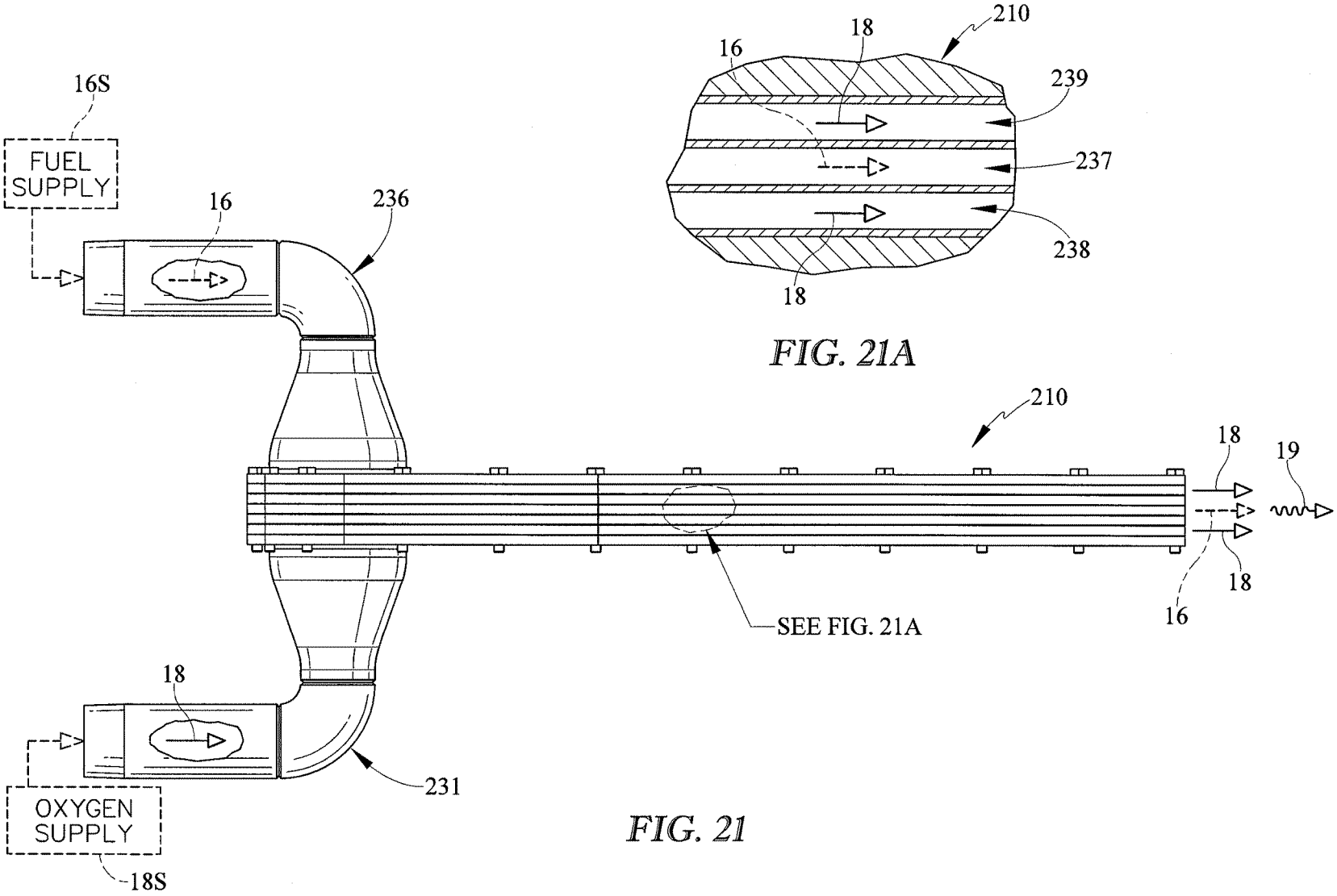
FIG. 21A is an enlarged sectional view taken in the circled region shown in FIG. 21 to show that the oxygen-fuel flat-flame nozzle is formed to include a lower oxygen-transport passageway, a (middle) fuel-transport passageway, and an upper oxygen-transport passageway.

Fluid conductor 232 of oxygen-fuel flat-flame nozzle 210 is shown in FIG. 20 to include (from bottom to top) a second lower plate 242L, a removable second plate-separation border frame 252, a first lower plate 241L, a removable first plate-separation border frame 250, a first upper plate 241U, a removable third plate-separation border frame 253, and a second upper plate 242U. Fasteners 255 can be used to hold all of these components together to produce fluid conductor 232. A collection of three alternate border frames 252', 250', and 253' is provided for technicians to use in the field as replacements for border frames 252, 250, and 253 in accordance with the present disclosure to change the firing capacity of burner apparatus 212 as suggested in FIG. 20.

Each of border frames 252, 250, and 253 (and alternate border frames 252', 250', and 253') comprises a U-shaped separator strip, a U-shaped top gasket arranged to lie above the companion separator strip, and a U-shaped bottom gasket arranged to lie below the companion separator strip as shown in FIG. 20. The thickness of each border frame can be varied by, for example, varying the thickness of the separator strip.

Flat-flame nozzle 210 also includes fastener means comprising several fasteners 255 for releasably retaining the removable first plate-separation border frame 250 in a stationary position between first lower plate 241L and first upper plate 241U to establish a first flow velocity of fuel 16 flowing through fuel-transport passageway 237 toward fuel-discharge outlet 234 and for allowing replacement of the removable first plate-separation border frame 250 with a removable alternate first plate-separation border frame 250' of a different thickness to establish a different second flow velocity of fuel 16 flowing through fuel-transport passageway 237 toward fuel-discharge outlet 234 as suggested in FIG. 20. Removable alternate first plate-separation border frame 250' is configured to occupy a space between first lower plate 241L and first upper plate 241U vacated by removable first plate-separation border frame 250 to establish the different second flow velocity of fuel 16 flowing through fuel transport passageway 237 toward fuel-discharge outlet 234 as suggested in FIG. 20. A technician can exchange border frames in the field to change the fired capacity of burner apparatus 212 easily after installation.

Figures 19, 19A:
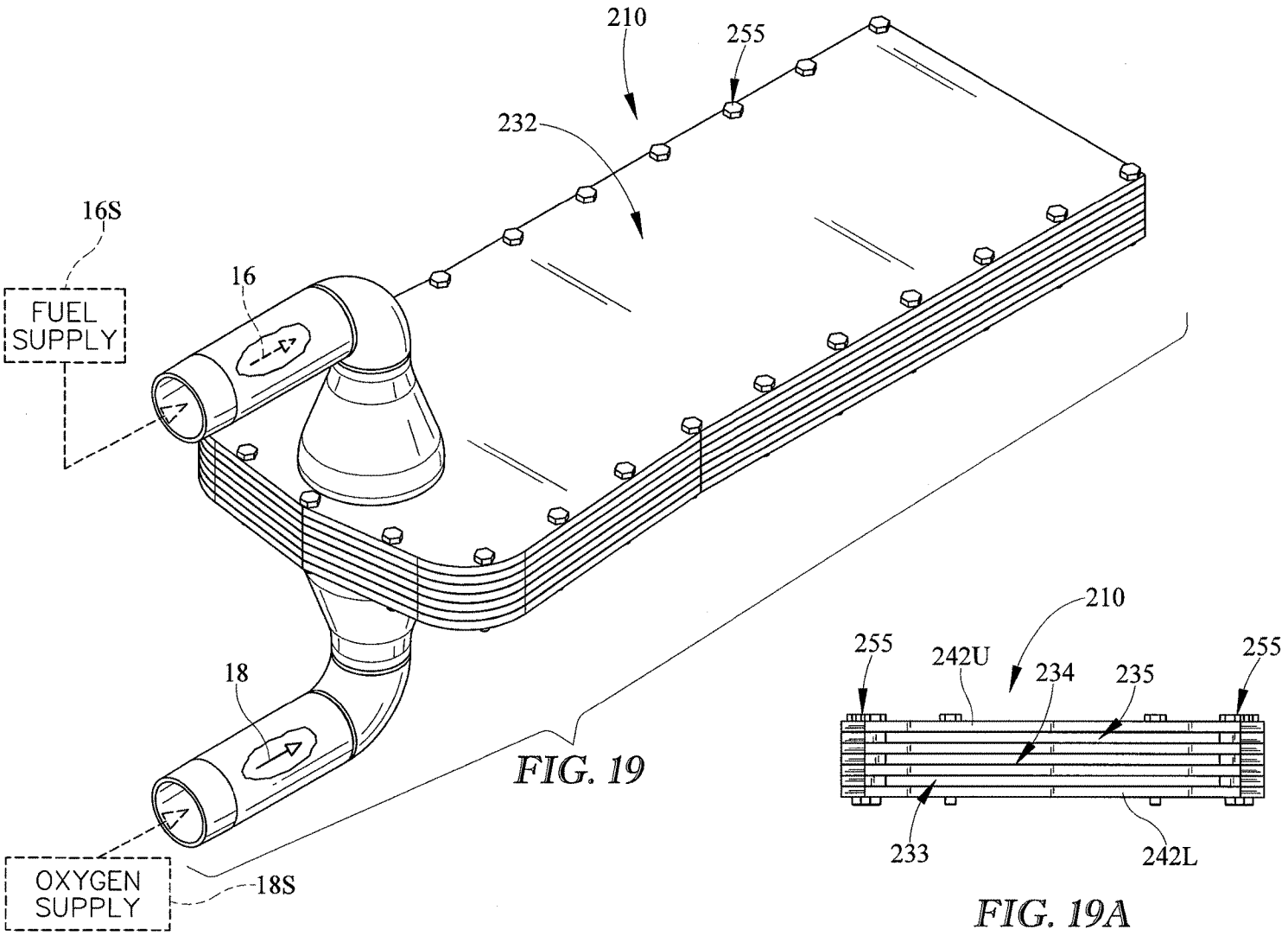
FIG. 19A is an end elevation view of the downstream end of the oxygen-fuel flat-flame nozzle of FIG. 19 shown in sequence (bottom to top) a rectangular lower oxygen-discharge outlet, a rectangular fuel-discharge outlet, and a rectangular upper oxygen-discharge outlet.

Fasteners 255 are passed through companion fastener-receiving apertures formed in each of plates 242L, 241L, 241U, and 242U and border frames 250, 252, and 253 as suggested in FIGS. 19 and 20 to retain the border frames 250, 252, and 253 in fixed positions relative to the plates 242L, 241L, 241U, and 242U as suggested in FIG. 20. Fasteners 255 can be removed by a technician in the field to replace removable first plate-separation border frame 250 with a relatively thicker or thinner removable alternate first plate-separation border frame 250' as suggested diagrammatically in FIG. 20. Similarly, border frame 252' can replace border frame 252 and border frame 253' can replace border frame 253. Such modifications can be made to change the fired capacity of burner 212 to be changed in the field by changing fuel and/or oxygen velocity flow rates in oxygen-fuel flat-flame nozzle 210 after installation at the option of the user.

Oxygen-fuel flat-flame nozzle 210 is also formed to include a lower oxygen-discharge outlet 233 and a lower oxygen-transport passageway 238 communicating with lower oxygen-discharge outlet 233 as suggested in FIGS. 19A, 20, and 21. Flat-flame nozzle 210 also includes a second lower plate 242L and a removable second plate-separation border frame 252 interposed between the first and second lower plates 241L, 242L and configured to cooperate therewith to form lower oxygen-discharge outlet 233 and lower oxygen-transport passageway 238. The fastener means is configured to provide means for releasably retaining the removable second plate-separation border frame 252 in a stationary position between first and second lower plates 241L, 242L to establish a first flow velocity of oxygen 18 flowing through lower oxygen-transport passageway 238 toward lower oxygen-discharge outlet 233 and for allowing replacement of the removable second plate-separation border frame 252 with a removable alternate second plate-separation border frame 252' of a different thickness to establish a different second flow velocity of oxygen 18 flowing through lower oxygen-transport passageway 238 toward lower oxygen-discharge outlet 233. Removable alternate second plate-separation border frame 252' is configured to occupy a space between first and second lower plates 241L, 242L vacated by removable second plate-separation border frame 252 to establish the different second flow velocity of oxygen 18 flowing through lower oxygen-transport passageway 238 toward lower oxygen-discharge outlet 233.

Oxygen-fuel flat-flame nozzle 210 is also formed to include an upper oxygen-discharge outlet 235 and an upper oxygen transport passageway 239 communicating with upper oxygen-discharge outlet 235 as suggested in FIGS. 19A, 20, and 21. Flat-flame nozzle 210 also includes a second upper plate 242U and a removable third plate-separation border frame 253 interposed between first and second upper plates 241U, 242U and configured to cooperate therewith to form upper oxygen-discharge outlet 235 and upper oxygen-transport passageway 239. The fastener means is configured to provide means for releasably retaining the removable third plate-separation border frame 253 in a stationary position between first and second upper plates 241U, 242U to establish a first flow velocity of oxygen 18 flowing through upper oxygen-transport passageway 239 toward upper oxygen-discharge outlet 235 and for allowing replacement of the removable third plate-separation border frame 253 with a removable alternate third plate-separation border frame 253' of a different thickness to establish a different second flow velocity of oxygen 18 flowing through upper oxygen-transport passageway 239 toward upper oxygen-discharge outlet 235. Removable alternate third plate-separation border frame 253' is configured to occupy a space between first and second upper plates 241U, 242U vacated by removable third plate-separation border frame 253 to establish the different second flow velocity oxygen 18 flowing through upper oxygen-transport passageway 239 toward upper oxygen-discharge outlet 235.

Second upper plate 242U is formed to include an exterior fuel-admission port 200E communicating with fuel-inlet pipe 236 as shown in FIG. 20. Each of the second upper plate 242U, removable third plate-separation border frame 253, and first upper plate 241U is formed to include an interior fuel-admission port 2001. Fuel-admission ports 2001 are aligned with one another and cooperate to provide fuel conductor means 200 for conducting fuel 16 discharged into the exterior fuel-admission port 200E formed in second upper plate 242U along a path 200P into fuel-transport passageway 237 for subsequent movement through fuel-transport passageway 237 to and through fuel-discharge outlet 234 as suggested in FIG. 20.

Second lower plate 242L is formed to include an exterior oxygen-admission port 201E communicating with oxygen-inlet pipe 231 and with the lower oxygen-transport passageway 238 as suggested in FIG. 20. Each of the first lower plate 241L, removable first plate-separation border frame 250, and first upper plate 241U is formed to include a first interior oxygen-admission port 2011. First interior oxygen-admission ports 2011 are aligned with one another and cooperate to provide first oxygen conductor means 201 for conducting a first portion of the oxygen 16 discharged into the lower oxygen-transport passageway 238 through the exterior oxygen-admission port 201E formed in second lower plate 242L along a first path 201P into the upper oxygen-transport passageway 239 for subsequent movement through the upper oxygen-transport passageway 239 to and through the upper oxygen-discharge outlet 235 while a second portion of the oxygen 18 discharged into the lower oxygen-transport passageway 238 through the exterior oxygen-admission port 201E formed in second lower plate 242L flows through the lower oxygen-transport passageway 238 to and through the lower oxygen-discharge outlet 233 as suggested in FIG. 20.

Each of the first lower plate 241L, removable first plate-separation border frame 250, and first upper plate 241U is formed to include a second interior oxygen-admission port 2021. Second interior oxygen-admission ports 2021 are aligned with one another and cooperate to provide second oxygen conductor means 202 for conducting a third portion of the oxygen 18 discharged into the lower oxygen-transport passageway 238 through the exterior oxygen-admission port 201E formed in second lower plate 242L along a separate second path 202P into the upper oxygen-transport passageway 239 for subsequent movement through the upper oxygen-transport passageway 239 to and through upper oxygen-discharge outlet 235. In an illustrative embodiment, interior fuel-admission port 2001 is formed in first upper plate 241U to lie between interior oxygen-admission ports 2011, 2021 as shown in FIG. 20.

Flat-flame nozzles in accordance with the present disclosure are configured to allow for the design and manufacture of high-aspect ratio (width to height) nozzles that produce flat-flame patterns. These nozzles comprise flat sheets formed to include special-shaped patterns cut using lasers or water jets. The flat sheets are stacked and fastened together to create a fuel path or fuel and oxygen flow paths that give the resulting flame its flat shape.

Because the flow paths for oxygen and fuel are shaped from individual sheets and those sheets are held together with removable fasteners, it is simple for technicians working in the field to disassemble flat-flame nozzles in accordance with the present disclosure and substitute a new sheet for either the oxygen or fuel flow passageway. For example, by replacing the fuel gas flow sheet with a thinner or thicker material metal, the effective capacity of the burner can be changed in the field without replacing the burner. Since flame luminosity can be determined in large part by the fuel velocity, in this way, the capacity of a burner in accordance with the present disclosure can be increased or decreased without changing the flame luminosity.

Flat-flame nozzles in accordance with the present disclosure use a metal sheet (made, for example, of stainless steel) cut by laser or water jet to create a flat-flame shape. Two matching thin-cut sheets of copper material (or other soft oxygen-compatible metal) are used on both sides of the specially shaped sheet to effect a gas seal to prevent fuel gas leakage from the nozzle. The sheet and the two copper gaskets are sandwiched between a full top and bottom sheet of standard thickness to form the fluid containment walls of the nozzle. The special-cut stainless steel (border frame) sheets can be produced from various thicknesses of material, and in this way, can be used to vary the flow capacity of the fuel gas nozzle. In use, the flat-flame nozzle would install into a burner housing and block in which the oxygen required for combustion would pass over, under, and around the fuel gas nozzle to mix and ignite in a flame zone beyond the end of the fuel gas nozzle.

In embodiments suggested, for example, in FIGS. 12-21, two additional border frames (each comprising a separator strip sheet and top and bottom gaskets) are provided and constructed to carry oxygen on both sides of fuel conducted through the nozzle. The oxygen is separated from the fuel by a full-size sheet provided between the oxygen cavities and the fuel cavity. Special flow passages cut into the nozzle sheets allow for oxygen to pass through the fuel gas layer without mixing with the fuel. In use, this oxygen-fuel flat-flame nozzle could be inserted through a slot in a wall or block without a housing required. The oxygen and fuel would mix and ignite at some point past the downstream end of the nozzle.

In accordance with the present disclosure, flat configuration fuel gas-oxygen nozzles are designed and manufactured with high aspect ratios. Burner nozzles in accordance with the present disclosure have aspect ratios ranging from about 10:1 to about 100:1.

Glass melting furnace use mainly radiant heat transfer. A burner nozzle that creates a flat thin flame over the glass surface is provided in accordance with the present disclosure to maximize the flame surface area directly over the surface of the glass.

When a glass furnace is designed, a burner firing capacity (measured in BTU's per hour) is specified by the designer. Replacement of the burner may be needed if the designer overestimates or underestimates the required burner firing capacity. In accordance with the present disclosure, a flat-flame nozzle is provided for a burner that allows the fired capacity to be adjusted simply and easily in the field by a technician. Such a flat-flame nozzle can be modified in the field to allow for fired capacity changes. By varying fuel velocity, a flame can be produced that is luminous and highly radiative as described by glass manufacturers or pale to blue for those end users preferring less transfer of radiation from the flame to the workload. Being able to determine and maintain an optimal fuel velocity in accordance with the present disclosure for maximum flame luminosity would improve glass furnace efficiency and performance.

The invention claimed is:

1. A burner apparatus comprising:

a flat-flame nozzle configured to conduct fuel and to provide means for generating a flat flame when fuel conducted by the flat-flame nozzle is exposed to oxygen to produce an oxygen-fuel mixture that is ignited, wherein the flat-flame nozzle is formed to include a fuel-discharge outlet and a fuel-transport passageway communicating with the fuel-discharge outlet, and the flat-flame nozzle includes a first lower plate, a first upper plate, a removable first plate-separation border frame interposed between the first lower plate and the first upper plate and configured to cooperate with the first lower plate and the first upper plate to form the fuel-discharge outlet and the fuel-transport passageway, and fastener means for releasably retaining the removable first plate-separation border frame in a stationary position between the first lower plate and the first upper plate to establish a first flow velocity of fuel flowing through the fuel-transport passageway toward the fuel-discharge outlet and for allowing replacement of the removable first plate-separation border frame with a removable alternate first plate-separation border frame of a different thickness to establish a different second flow velocity of fuel flowing through the fuel-transport passageway toward the fuel-discharge outlet;

wherein the removable first plate-separation border frame is configured to include a first separator strip having a first thickness, a bottom gasket positioned to lie between the first lower plate and the first separator strip, and a top gasket positioned to lie between the first upper plate and the first separator strip.

2. The burner apparatus of claim 1, wherein the removable alternate first plate-separation border frame is configured to occupy a space between the first lower plate and the first upper plate vacated by the removable first plate-separation border frame to establish the different second flow velocity of fuel flowing through the fuel-transport passageway toward the fuel-discharge outlet and the removable alternate first plate-separation border frame is configured to include a second separator strip having a different second thickness, a bottom gasket positioned to lie between the first lower plate and the second separator strip, and a top gasket positioned to lie between the first upper plate and the second separator strip.

3. The burner apparatus of claim 1, wherein the fastener means includes several fasteners and each of the fasteners extends through a companion fastener-receiving aperture formed in each of the first lower plate, bottom gasket, first separator strip, top gasket, and first upper plate.

4. The burner apparatus of claim 3, wherein each of the first lower plate and the first upper plate is rectangular and has perimeter portions formed to include fastener-receiving apertures and each of the first separator strip and bottom and top gaskets is U-shaped and arranged to cause an open end thereof to establish a portion of the fuel-discharge outlet.

5. The burner apparatus of claim 1, wherein the first separator strip is made of stainless steel and each of the bottom and top gaskets is made of copper.

6. The burner apparatus of claim 1, wherein the first upper plate is formed to include a shallow upper recess facing toward the first lower plate and arranged to lie in spaced-apart relation to the fuel-discharge outlet to locate the fuel-transport passageway therebetween.

7. The burner apparatus of claim 6, wherein the first lower plate is formed to include a shallow lower recess facing toward the first upper plate and cooperating with the shallow upper recess and an inner edge of one of the removable first plate-separation border frame and the removable alternate first plate-separation border frame to form a fuel-receiving plenum configured to provide fuel distribution means for collecting fuel admitted into the shallow upper recess and distributing collected fuel into the fuel-transport passageway for downstream movement toward the fuel-discharge outlet and the fuel-transport passageway is arranged to conduct fuel discharged from the fuel-receiving plenum to the fuel-discharge outlet.

8. The burner apparatus of claim 6, wherein the first upper plate includes an exterior surface facing away from the first lower plate and an interior surface facing toward the first lower plate and defining boundary portions of the shallow upper recess and the fuel-transport passageway, the first upper plate is formed to include a fuel-admission port having an inlet formed in the exterior surface and an outlet formed in the interior surface to open into the shallow upper recess, and further comprising a fuel-inlet pipe coupled to the first upper plate at the fuel-admission port and configured to conduct fuel into the shallow upper recess for subsequent movement through the fuel-transport passageway to and through the fuel-discharge outlet.

9. The burner apparatus of claim 6, wherein the removable first plate-separation border frame is configured to include a first separator strip having a first thickness, a bottom gasket positioned to lie between the first lower plate and the first separator strip, and a top gasket positioned to lie between the first upper plate and the first separator strip, the fastener means includes several fasteners and each of the fasteners extends through a companion fastener-receiving aperture formed in each of the first lower plate, bottom gasket, first separator strip, top gasket, and first upper plate, each of the first lower plate and the first upper plate is rectangular and has perimeter portions formed to include fastener-receiving apertures and each of the first separator strip and bottom and top gaskets is U-shaped and arranged to cause an open end thereof to establish a portion of the fuel-discharge outlet, and each of the first separator strip and the bottom and top gaskets includes a first leg, a second leg arranged to lie in spaced-apart relation to the first leg, and a bight portion arranged to interconnect upstream ends of the first and second legs and lie in spaced-apart relation to the fuel-transport passageway, and the shallow lower recess is located between each of the bight portions and fuel-transport passageway and between each of the first legs and each of the second legs.

10. The burner apparatus of claim 1, wherein the flat-flame nozzle is also formed to include a lower oxygen-discharge outlet and a lower oxygen-transport passageway communicating with the lower oxygen-discharge outlet and further comprising a second lower plate and a removable second plate-separation border frame interposed between the first and second lower plates and configured to cooperate therewith to form the lower oxygen-discharge outlet and the lower oxygen-transport passageway, and the fastener means is configured to provide means for releasably retaining the removable second plate-separation border frame in a stationary position between the first and second lower plates to establish a first flow velocity of oxygen flowing through the lower oxygen-transport passageway toward the lower oxygen-discharge outlet and for allowing replacement of the removable second plate-separation border frame with a removable alternate second plate-separation border frame of a different thickness to establish a different second flow velocity of oxygen flowing through the lower oxygen-transport passageway toward the lower oxygen-discharge outlet.

11. The burner apparatus of claim 10, wherein the removable second plate-separation border frame is configured to include a first separator strip having a first thickness, a bottom gasket positioned to lie between the second lower plate and the first separator strip, and a top gasket positioned to lie between the first lower plate and the first separator strip, the removable alternate second plate-separation border frame is configured to occupy a space between the first and second lower plates vacated by the removable second plate-separation border frame to establish the different second flow velocity of oxygen flowing through the lower oxygen-transport passageway toward the lower oxygen-discharge outlet, and the removable alternate second plate-separation border frame is configured to include a second separator strip having a different second thickness, a bottom gasket positioned to lie between the second lower plate and the second separator strip, and a top gasket positioned to lie between the first lower plate and the second separator strip.

12. The burner apparatus of claim 10, wherein the flat-flame nozzle is also formed to include an upper oxygen-discharge outlet and an upper oxygen-transport passageway communicating with the upper oxygen-discharge outlet and further comprising a second upper plate and a removable third plate-separation border frame interposed between the first and second upper plates and configured to cooperate therewith to form the upper oxygen-discharge outlet and the upper oxygen-transport passageway, and the fastener means is configured to provide means for releasably retaining the removable third plate-separation border frame in a stationary position between the first and second upper plates to establish a first flow velocity of oxygen flowing through the upper oxygen-transport passageway toward the upper oxygen-discharge outlet and for allowing replacement of the removable third plate-separation border frame with a removable alternate third plate-separation border frame of a different thickness to establish a different second flow velocity of oxygen flowing through the upper oxygen-transport passageway toward the upper oxygen-discharge outlet.

13. The burner apparatus of claim 12, wherein each of the second upper plate, removable third plate-separation border frame, and first upper plate is formed to include a fuel-admission port and said fuel-admission ports are aligned with one another and cooperate to provide fuel conductor means for conducting fuel discharged into the fuel-admission port formed in the second upper plate into the fuel-transport passageway for subsequent movement through the fuel-transport passageway to and through the fuel-discharge outlet, wherein the second lower plate is formed to include an exterior oxygen-admission port communicating with the lower oxygen-transport passageway, and wherein each of the first lower plate, removable first plate-separation border frame, and first upper plate is formed to include a first interior oxygen-admission port and said first interior oxygen-admission ports are aligned with one another and cooperate to provide first oxygen conductor means for conducting a first portion of the oxygen discharged into the lower oxygen-transport passageway through the exterior oxygen-admission port formed in the second lower plate along a first path into the upper oxygen-transport passageway for subsequent movement through the upper oxygen-transport passageway to and through the upper oxygen-discharge outlet while a second portion of the oxygen discharged into the lower oxygen-transport passageway through the exterior oxygen-admission port formed in the second lower plate flows through the lower oxygen-transport passageway to and through the lower oxygen-discharge outlet.

14. The burner apparatus of claim 13, wherein each of the first lower plate, removable first plate-separation border frame, and first upper plate is formed to include a second interior oxygen-admission port and said second interior oxygen-admission ports are aligned with one another and cooperate to provide second oxygen conductor means for conducting a third portion of the oxygen discharged into the lower oxygen-transport passageway through the exterior oxygen-admission port formed in the second lower plate along a separate second path into the upper oxygen-transport passageway for subsequent movement through the upper oxygen-transport passageway to and through the upper oxygen-discharge outlet.

15. A burner apparatus comprising:

a flat-flame nozzle including, in series, a second lower plate, a first lower plate, a first upper plate, and second upper plate, wherein the flat-flame nozzle further includes a removable first plate-separation border frame trapped temporarily between the first lower and upper plates to form a fuel-transport passageway therebetween terminating in a fuel-discharge outlet, a removable second plate-separation border frame trapped temporarily between the first and second lower plates to form a lower oxygen-transport passageway therebetween terminating in a lower oxygen-discharge outlet, and a removable third plate-separation border frame trapped temporarily between the first and second upper plates to form an upper oxygen-transport passageway therebetween terminating in an upper oxygen-discharge outlet, and fastener means for releasably retaining the plates and border frames in stationary positions relative to one another until at least one of the border frames is replaced with a companion alternate border frame of a different thickness to change the firing capacity of the burner;

wherein the removable first plate-separation border frame is configured to include a first separator strip having a first thickness, a bottom gasket positioned to lie between the first lower plate and the first separator strip, and a top gasket positioned to lie between the first upper plate and the first separator strip.

16. The burner apparatus of claim 15, wherein the fastener means includes several fasteners and each of the fasteners extends through a companion fastener-receiving aperture formed in each of the second lower plate, removable second plate-separation border frame, first lower plate, removable first plate-separation border frame, first upper plate, removable third plate-separation border frame, and second upper plate.

17. The burner apparatus of claim 15, wherein each of the second upper plate, removable third plate-separation border frame, and first upper plate is formed to include a fuel-admission port and said fuel-admission ports are aligned with one another and cooperate to provide fuel conductor means for conducting fuel discharged into the fuel-admission port formed in the second upper plate into the fuel-transport passageway for subsequent movement through the fuel-transport passageway to and through the fuel-discharge outlet, wherein the second lower plate is formed to include an exterior oxygen-admission port communicating with the lower oxygen-transport passageway, and wherein each of the first lower plate, removable first plate-separation border frame, and first upper plate is formed to include a first interior oxygen-admission port and said first interior oxygen-admission ports are aligned with one another and cooperate to provide first oxygen conductor means for conducting a first portion of the oxygen discharged into the lower oxygen-transport passageway through the exterior oxygen-admission port formed in the second lower plate along a first path into the upper oxygen-transport passageway for subsequent movement through the upper oxygen-transport passageway to and through the upper oxygen-discharge outlet while a second portion of the oxygen discharged into the lower oxygen-transport passageway through the exterior oxygen-admission port formed in the second lower plate flows through the lower oxygen-transport passageway to and through the lower oxygen-discharge outlet.

18. The burner apparatus of claim 17, wherein each of the first lower plate, removable first plate-separation border frame, and first upper plate is formed to include a second interior oxygen-admission port and said second interior oxygen-admission ports are aligned with one another and cooperate to provide second oxygen conductor means for conducting a third portion of the oxygen discharged into the lower oxygen-transport passageway through the exterior oxygen-admission port formed in the second lower plate along a separate second path into the upper oxygen-transport passageway for subsequent movement through the upper oxygen-transport passageway to and through the upper oxygen-discharge outlet.

19. A burner apparatus comprising:

a flat-flame nozzle configured to conduct fuel and to provide means for generating a flat flame when fuel conducted by the flat-flame nozzle is exposed to oxygen to produce an oxygen-fuel mixture that is ignited, wherein the flat-flame nozzle is formed to include a fuel-discharge outlet and a fuel-transport passageway communicating with the fuel-discharge outlet, and the flat-flame nozzle includes a first lower plate, a first upper plate, a removable first plate-separation border frame interposed between the first lower plate and the first upper plate and configured to cooperate with the first lower plate and the first upper plate to form the fuel-discharge outlet and the fuel-transport passageway, and fastener means for releasably retaining the removable first plate-separation border frame in a stationary position between the first lower plate and the first upper plate to establish a first flow velocity of fuel flowing through the fuel-transport passageway toward the fuel-discharge outlet and for allowing replacement of the removable first plate-separation border frame with a removable alternate first plate-separation border frame of a different thickness to establish a different second flow velocity of fuel flowing through the fuel-transport passageway toward the fuel-discharge outlet;

wherein the first upper plate is formed to include a shallow upper recess facing toward the first lower plate and arranged to lie in spaced-apart relation to the fuel-discharge outlet to locate the fuel-transport passageway therebetween.

20. A burner apparatus comprising:

a flat-flame nozzle configured to conduct fuel and to provide means for generating a flat flame when fuel conducted by the flat-flame nozzle is exposed to oxygen to produce an oxygen-fuel mixture that is ignited, wherein the flat-flame nozzle is formed to include a fuel-discharge outlet and a fuel-transport passageway communicating with the fuel-discharge outlet, and the flat-flame nozzle includes a first lower plate, a first upper plate, a removable first plate-separation border frame interposed between the first lower plate and the first upper plate and configured to cooperate with the first lower plate and the first upper plate to form the fuel-discharge outlet and the fuel-transport passageway, and fastener means for releasably retaining the removable first plate-separation border frame in a stationary position between the first lower plate and the first upper plate to establish a first flow velocity of fuel flowing through the fuel-transport passageway toward the fuel-discharge outlet and for allowing replacement of the removable first plate-separation border frame with a removable alternate first plate-separation border frame of a different thickness to establish a different second flow velocity of fuel flowing through the fuel-transport passageway toward the fuel-discharge outlet;

wherein the flat-flame nozzle is also formed to include a lower oxygen-discharge outlet and a lower oxygen-transport passageway communicating with the lower oxygen-discharge outlet and further comprising a second lower plate and a removable second plate-separation border frame interposed between the first and second lower plates and configured to cooperate therewith to form the lower oxygen-discharge outlet and the lower oxygen-transport passageway, and the fastener means is configured to provide means for releasably retaining the removable second plate-separation border frame in a stationary position between the first and second lower plates to establish a first flow velocity of oxygen flowing through the lower oxygen-transport passageway toward the lower oxygen-discharge outlet and for allowing replacement of the removable second plate-separation border frame with a removable alternate second plate-separation border frame of a different thickness to establish a different second flow velocity of oxygen flowing through the lower oxygen-transport passageway toward the lower oxygen-discharge outlet.

21. A burner apparatus comprising:

a flat-flame nozzle including, in series, a second lower plate, a first lower plate, a first upper plate, and second upper plate, wherein the flat-flame nozzle further includes a removable first plate-separation border frame trapped temporarily between the first lower and upper plates to form a fuel-transport passageway therebetween terminating in a fuel-discharge outlet, a removable second plate-separation border frame trapped temporarily between the first and second lower plates to form a lower oxygen-transport passageway therebetween terminating in a lower oxygen-discharge outlet, and a removable third plate-separation border frame trapped temporarily between the first and second upper plates to form an upper oxygen-transport passageway therebetween terminating in an upper oxygen-discharge outlet, and fastener means for releasably retaining the plates and border frames in stationary positions relative to one another until at least one of the border frames is replaced with a companion alternate border frame of a different thickness to change the firing capacity of the burner;

wherein the fastener means includes several fasteners and each of the fasteners extends through a companion fastener-receiving aperture formed in each of the second lower plate, removable second plate-separation border frame, first lower plate, removable first plate-separation border frame, first upper plate, removable third plate-separation border frame, and second upper plate.

22. A burner apparatus comprising:

a flat-flame nozzle including, in series, a second lower plate, a first lower plate, a first upper plate, and second upper plate, wherein the flat-flame nozzle further includes a removable first plate-separation border frame trapped temporarily between the first lower and upper plates to form a fuel-transport passageway therebetween terminating in a fuel-discharge outlet, a removable second plate-separation border frame trapped temporarily between the first and second lower plates to form a lower oxygen-transport passageway therebetween terminating in a lower oxygen-discharge outlet, and a removable third plate-separation border frame trapped temporarily between the first and second upper plates to form an upper oxygen-transport passageway therebetween terminating in an upper oxygen-discharge outlet, and fastener means for releasably retaining the plates and border frames in stationary positions relative to one another until at least one of the border frames is replaced with a companion alternate border frame of a different thickness to change the firing capacity of the burner;

wherein each of the second upper plate, removable third plate-separation border frame, and first upper plate is formed to include a fuel-admission port and said fuel-admission ports are aligned with one another and cooperate to provide fuel conductor means for conducting fuel discharged into the fuel-admission port formed in the second upper plate into the fuel-transport passageway for subsequent movement through the fuel-transport passageway to and through the fuel-discharge outlet, wherein the second lower plate is formed to include an exterior oxygen-admission port communicating with the lower oxygen-transport passageway, and wherein each of the first lower plate, removable first plate-separation border frame, and first upper plate is formed to include a first interior oxygen-admission port and said first interior oxygen-admission ports are aligned with one another and cooperate to provide first oxygen conductor means for conducting a first portion of the oxygen discharged into the lower oxygen-transport passageway through the exterior oxygen-admission port formed in the second lower plate along a first path into the upper oxygen-transport passageway for subsequent movement through the upper oxygen-transport passageway to and through the upper oxygen-discharge outlet while a second portion of the oxygen discharged into the lower oxygen-transport passageway through the exterior oxygen-admission port formed in the second lower plate flows through the lower oxygen-transport passageway to and through the lower oxygen-discharge outlet.

* * * * *